US008121498B2

(12) United States Patent
Uno et al.

(10) Patent No.: US 8,121,498 B2
(45) Date of Patent: Feb. 21, 2012

(54) IMAGE FORMING APPARATUS AND DEVELOPER SUPPLY METHOD THEREFOR

(75) Inventors: Mugijiro Uno, Isehara (JP); Keiko Matsumoto, Yokohama (JP); Takuzi Yoneda, Tokyo (JP); Yuki Oshikawa, Yamato (JP)

(73) Assignee: Ricoh Company, Limited, Tokyo (JP)

( * ) Notice: Subject to any disclaimer, the term of this patent is extended or adjusted under 35 U.S.C. 154(b) by 578 days.

(21) Appl. No.: 12/253,538

(22) Filed: Oct. 17, 2008

(65) Prior Publication Data

US 2009/0103935 A1 Apr. 23, 2009

(30) Foreign Application Priority Data

Oct. 23, 2007 (JP) ..... 2007-275555

(51) Int. Cl.
*G03G 15/06* (2006.01)
*G03G 15/14* (2006.01)
*G03G 21/00* (2006.01)

(52) U.S. Cl. ..... 399/27; 399/61; 399/256; 399/258

(58) Field of Classification Search ..... 399/27, 399/29, 30, 58, 59, 60, 61, 62, 63, 224, 255, 399/256, 258, 263, 298, 299, 300, 302, 308
See application file for complete search history.

(56) References Cited

U.S. PATENT DOCUMENTS

| | | | | |
|---|---|---|---|---|
| 4,965,637 | A | 10/1990 | Katoh et al. | |
| 5,099,286 | A | 3/1992 | Nishise et al. | |
| 5,227,842 | A | 7/1993 | Hayashi et al. | |
| 5,257,076 | A | 10/1993 | Nishimura et al. | |
| 5,978,643 | A | 11/1999 | Uno | |
| 6,022,660 | A | 2/2000 | Uno | |
| 6,033,818 | A | 3/2000 | Sugiyama et al. | |
| 6,226,481 | B1 | 5/2001 | Yoneda et al. | |
| 6,512,901 | B2 | 1/2003 | Uno | |
| 7,280,773 | B2 | 10/2007 | Uno | |
| 7,313,347 | B2 | 12/2007 | Shintani et al. | |
| 7,333,744 | B2 | 2/2008 | Shimojo et al. | |
| 7,373,101 | B2 | 5/2008 | Hozumi et al. | |
| 2003/0068167 | A1 | 4/2003 | Coriale et al. | |
| 2004/0131390 | A1* | 7/2004 | Kita | 399/258 |
| 2004/0151514 | A1* | 8/2004 | Shuji | 399/29 |

(Continued)

FOREIGN PATENT DOCUMENTS

| | | | |
|---|---|---|---|
| EP | 0 519 710 | B1 | 8/1996 |

(Continued)

*Primary Examiner* — David Gray
*Assistant Examiner* — Fred L Braun
(74) *Attorney, Agent, or Firm* — Oblon, Spivak, McClelland, Maier & Neustadt, L.L.P.

(57) ABSTRACT

An image forming method and apparatus, the apparatus including a latent image carrier configured to carry a latent image thereon, a developing unit disposed facing the latent image carrier to develop the latent image with developer, a developer container containing the developer and attachable to the image forming apparatus, a developer detector configured to detect the presence of the developer in the developing unit, and a developer supply controller, and a disengagement detector configured to detect whether or not an intermediate transfer member is disengaged from the latent image carrier. The developer supply controller prohibits supply of the developer from the developer container to the developing unit when the developer detector detects that the developer is present in the developing unit, and when the disengagement detector detects that the intermediate transfer member is not disengaged from the latent image carrier.

16 Claims, 24 Drawing Sheets

U.S. PATENT DOCUMENTS

| | | | | |
|---|---|---|---|---|
| 2005/0117936 | A1 | 6/2005 | Takami | |
| 2005/0271420 | A1 | 12/2005 | Arai et al. | |
| 2005/0281593 | A1 | 12/2005 | Ozeki et al. | |
| 2006/0008281 | A1* | 1/2006 | Matsumoto et al. | 399/27 |
| 2006/0115286 | A1 | 6/2006 | Uchitani et al. | |
| 2006/0133834 | A1 | 6/2006 | Yoneda et al. | |
| 2007/0047985 | A1* | 3/2007 | Kamijo et al. | 399/45 |
| 2007/0059054 | A1 | 3/2007 | Furukawa | |
| 2007/0116494 | A1 | 5/2007 | Uno et al. | |
| 2007/0196123 | A1 | 8/2007 | Mizuishi et al. | |
| 2007/0280742 | A1 | 12/2007 | Matsumoto et al. | |
| 2008/0063434 | A1 | 3/2008 | Uno et al. | |
| 2008/0124136 | A1 | 5/2008 | Oshikawa | |
| 2008/0175628 | A1 | 7/2008 | Kita et al. | |
| 2008/0175635 | A1 | 7/2008 | Hozumi et al. | |
| 2008/0181630 | A1 | 7/2008 | Matsumoto et al. | |
| 2008/0181670 | A1 | 7/2008 | Tsuda et al. | |
| 2008/0187332 | A1 | 8/2008 | Tsuda et al. | |
| 2008/0240792 | A1 | 10/2008 | Kita et al. | |
| 2008/0253810 | A1 | 10/2008 | Tateyama et al. | |
| 2008/0279592 | A1 | 11/2008 | Matsumoto et al. | |

FOREIGN PATENT DOCUMENTS

| | | | | |
|---|---|---|---|---|
| JP | 2000-98721 | | | 4/2000 |
| JP | 2001242680 | A | * | 9/2001 |
| JP | 2003-57882 | | | 2/2003 |
| JP | 2006-84892 | | | 3/2006 |
| JP | 2006201338 | A | * | 8/2006 |
| JP | 2008176245 | A | * | 7/2008 |

* cited by examiner

IMAGE FORMING APPARATUS AND DEVELOPER SUPPLY METHOD THEREFOR

CROSS-REFERENCE TO RELATED APPLICATIONS

This patent specification claims priority from Japanese Patent Application No. 2007-275555, filed on Oct. 23, 2007 in the Japan Patent Office, the entire contents of which are hereby incorporated by reference herein.

BACKGROUND OF THE INVENTION

1. Field of the Invention

The present invention generally relates to an image forming apparatus, such as a facsimile machine, a copier, a printer, a multifunction machine including at least two of those functions, etc., and a developer supply method therefor.

2. Discussion of the Background

In general, an electrophotographic image forming apparatus, such as a copier, a printer, a facsimile machine, a multifunction machine including at least two of those functions, etc., includes an image forming mechanism for forming an electrostatic latent image on an image carrier, developing the latent image with developer, and transferring the developed image (toner image) onto a recording medium. As the developer, two-component developer in which toner and magnetic carrier are mixed is widely used.

The electronographic image forming apparatus has a developing unit, which typically includes a developing roller serving as a developer carrier that supplies the image carrier with the developer. The developing roller is partly exposed from an opening in the developing unit, and therefore, in such an image forming apparatus, the developer might spill out from the opening in the developing unit, particularly if a developer container part of the developing unit is filled with the developer before shipment and the developer container is shaken or the image forming apparatus tilts during transport. Further, the developer might deteriorate by being exposed to air. Therefore, the developer is typically put in the developer container part at a user's site.

In addition, because the magnetic carrier deteriorates over time and thus development capability is impaired with repeated use of the two-component developer, the developer including the degraded magnetic carrier should be periodically replaced.

As a typical developer replacement method, maintenance personnel visit the user each given cycle in order to collect the degraded developer and replenish the developing unit with unused developer. human error is inherent in such a method.

Herein, human error means the maintenance personnel might supply unused developer to the developer container part without removing the degraded developer therefrom, which is hereinafter referred to as redundant replenishment. Further, the maintenance personnel might forget having already filled it with the developer, and supply redundant developer to a developing unit of a newly installed image forming apparatus or a developing unit from which the degraded developer is removed.

As another example of human error, in a case of a color image forming apparatus including multiple developing units respectively corresponding to multiple color toners, the maintenance personnel might set a developer bottle of the wrong color to a developer supply port of the developing unit to which unused developer is to be supplied.

If redundant replenishment occurs, developer will spill over from the developing unit, and the developer remaining in the developer bottle will be spilled over the image forming apparatus when the developer bottle is removed from the developing unit, which might contaminate and damage the image forming apparatus.

Accordingly, there is a need to prevent such human error, as well as shorten a time period required to fill the developing unit with the developer and distribute the developer uniformly therein.

SUMMARY OF THE INVENTION

In view of the foregoing, in one illustrative embodiment of the present invention, an image forming apparatus includes an latent image carrier configured to carry a latent image thereon, a developing unit disposed facing the latent image carrier to develop the latent image with developer, a developer container configured to contain the developer and be attached to the image forming apparatus, a developer detector configured to detect the presence of the developer in the developing unit, and a developer supply controller. The developer supply controller prohibits supply of the developer from the developer container to the developing unit when the developer detector detects that the developer is present in the developing unit.

Another illustrative embodiment of the present invention describes a developer supply method used in the image forming apparatus described above. The developer supply method includes determining whether or not the developer is present in the developing unit, and prohibiting supply of the developer to the developing unit from the developer container when the developer is determined to be present therein.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
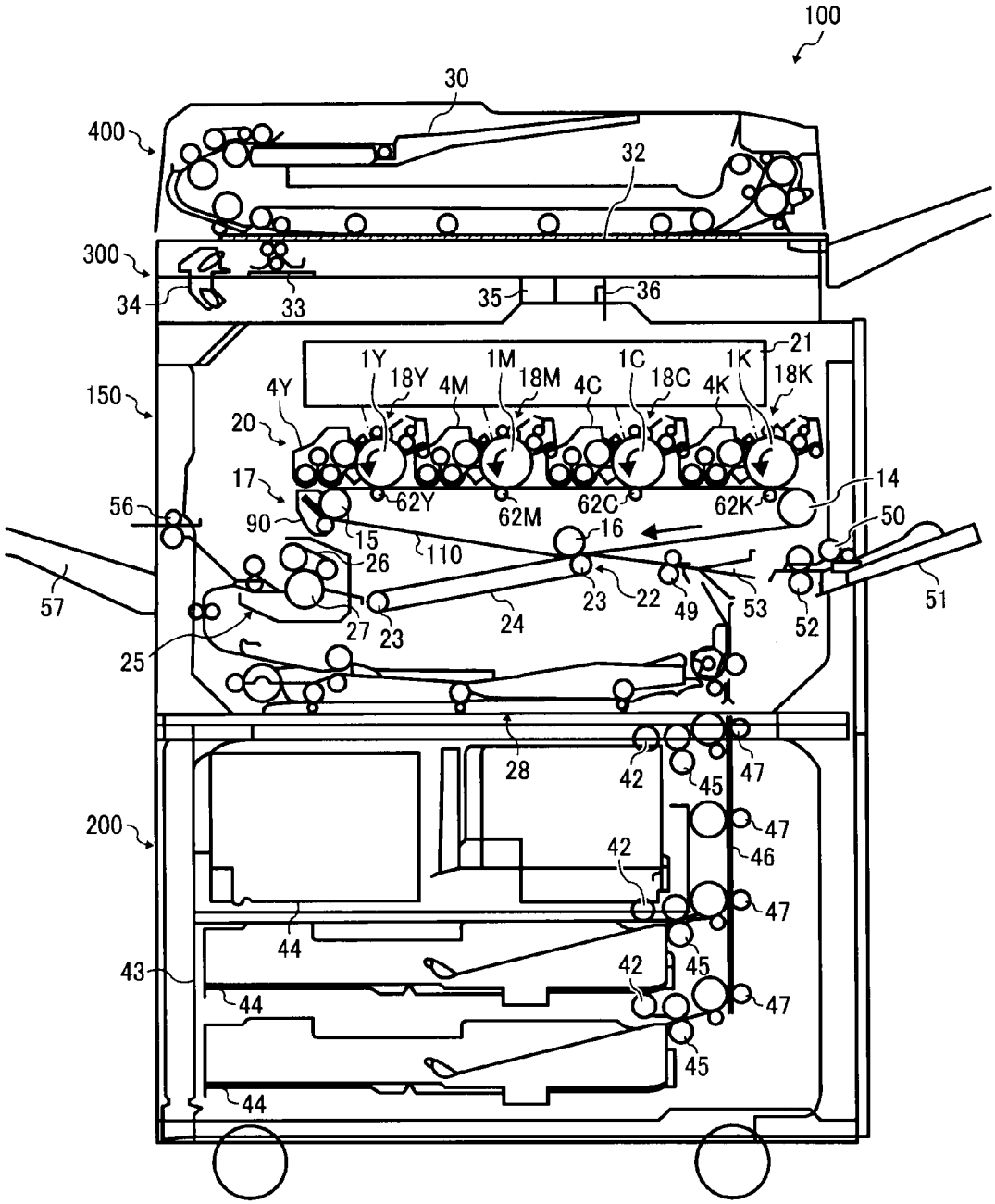
FIG. 1 schematically illustrates a configuration of an image forming apparatus according to an illustrative embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an illustrative embodiment of the present invention is described. The image forming apparatus in the present embodiment is a tandem color laser copier in which multiple photoreceptors are arranged in parallel to each other.

FIG. 1 schematically illustrates a configuration of a tandem color laser copier 100 (hereinafter simply "copier 100") according to the present embodiment. The copier 100 includes a print unit 150, a sheet feeder 200 on which the print unit 150 is located, a scanner 300 fixed on the printer 150, and an automatic document feeder (ADF) 400 fixed on the scanner 300.

The print unit 150 includes an image forming unit 20, an optical writing unit 21, an intermediate transfer unit 17, a secondary transfer unit 22, a pair of registration rollers 49, a belt type fixer 25, and a sheet reverse unit 28 for reversing a transfer sheet that is a recording medium in a duplex print mode. The image forming unit 20 includes four process cartridges 18Y, 18M, 18C, and 18K for forming yellow, magenta, cyan, and black images, respectively.

It is to be noted that the reference characters Y, M, C, and K respectively represent yellow, magenta, cyan, and black, and may be omitted in the description below when color discrimination is not required.

Each process cartridge 18 includes a drum-shaped photoreceptor and a developing unit 4. The optical writing unit 21 includes a light source, a polygon mirror, an f-θ lens, and a reflection mirror, and directs a laser light (exposure light) onto each photoreceptor 1 according to image data.

The process cartridge 18K is described below in further detail.

The process cartridge 18K further includes a charger, a drum cleaner that in the present embodiment is a cleaning blade, and a discharger, although not illustrated in FIG. 1. After the charger charges a surface of the photoreceptor 1Y uniformly, the optical writing unit 21 directs a modulated and deflected laser light thereonto, and thus electrical potential of the exposed portions of the surface of the photoreceptor 1Y is attenuated. Thus, an electrostatic latent image for yellow is formed thereon. Subsequently, the developing unit 4 develops the latent image into a yellow toner image.

Then, the yellow toner image is transferred from the photoreceptor 1Y onto an intermediate transfer belt 110 serving as an intermediate transfer member by the intermediate transfer unit 17 serving as a transferor. Subsequent to this primary transfer process, the drum cleaner cleans the surface of the photoreceptor 1Y, and the discharger removes electricity remaining thereon. Then, the surface of the photoreceptor 1Y is again charged uniformly by the charger and thus initialized.

The sequence of processes described above are similarly performed in the process cartridges 18M, 18C, and 18K, and thus magenta, cyan, and black toner images are respectively formed therein.

It is to be noted that the four process cartridges 18Y, 18M, 18C, and 18K have a similar configuration and operates in a similar manner except the color of toners used therein, and thus descriptions of the process cartridges 18M, 18C, and 18K are omitted.

The intermediate transfer unit 17 is described below in further detail.

The intermediate transfer unit 17 includes the intermediate transfer belt 110, a belt cleaner 90, a roller 14, a driving roller 15, a back-up roller 16, and primary transfer rollers 62Y, 62M, 62C, and 62K.

The intermediate transfer belt 110 is looped around the roller 14, the driving roller 15, and the back-up roller 16, and endlessly travels clockwise in FIG. 1 with the driving roller 15 that is driven by a motor.

The primary transfer rollers 62Y, 62M, 62C, and 62K are located to contact an inner surface of the intermediate transfer belt 110 and receives bias voltage from a power source. Further, the primary transfer rollers 62Y, 62M, 62C, and 62K press the intermediate transfer belt 110 against the photoreceptors 1Y, 1M, 1C, and 1K, respectively forming primary transfer nips where primary transfer electrical fields are formed between the photoreceptors 1Y, 1M, 1C, and 1K and the primary transfer rollers 62Y, 62M, 62C, and 62K.

The yellow toner image formed on the photoreceptor 1Y is transferred onto the intermediate transfer belt 110 due to effects of the primary transfer electrical field and a nip pressure. On the yellow toner image, the magenta, cyan, and black toner images respectively formed on the photoreceptors 1M, 1C, and 1K are superimposed one on another in the primary transfer process. Thus, a multicolor image, which in the present embodiment is a four-color image, is formed on the intermediate transfer belt 110.

The four-color image is then transferred by the secondary transfer unit 22 onto a transfer sheet in a secondary transfer nip. The belt cleaner 90 faces the driving roller 15 via the intermediate transfer belt 110, and removes toner remaining on the intermediate transfer belt 110 that has passed through the secondary transfer nip.

The secondary transfer unit 22 is described below in further detail.

The secondary transfer unit 22 is located beneath the intermediate transfer unit 17 in FIG. 1, and includes a transport belt 24 looped around a pair of rollers 23. The transport belt 24 endlessly travels counterclockwise in FIG. 1 with rotation of at least one of the rollers 23. The intermediate transfer belt 110 and the transport belt 24 are sandwiched between the back-up roller 16 and the roller 23 on the right, forming the secondary transfer nip therebetween. Further, the right side roller 23 receives a secondary transfer bias having a polarity opposite a polarity of the toner from a power source.

With the secondary transfer bias, a secondary transfer electrical field for causing the four-color image on the intermediate transfer belt 110 to move to the side of the roller 23 is formed in the secondary transfer nip. Thus, due to effects of the secondary transfer electrical field and a nip pressure, the four-color image is transferred onto the transfer sheet that is forwarded by the registration rollers 49 in synchronization with the four-color image.

It is to be noted that, instead of the secondary transfer method in which the secondary transfer bias is applied to the roller 23 as described above, alternatively, a method using a charger that charges the transfer sheet in a non-contact manner can be adopted.

The sheet feeder 200 includes a paper bank 43 in which multiple sheet cassettes 44 are arranged one above another, and a sheet feed path 46 provided with multiple pairs of transport rollers 47. Each sheet cassette 44 contains a stack of transfer sheets against which a feed roller 42 presses from above. The transfer sheets are fed from the top with rotation of the feed roller 42, and a separation roller 45 separates the transfer sheets one by one.

Then, the sheet is transported along the sheet feed path 46 to the registration rollers 49. While the registration rollers 49 sandwich the transfer sheet therebetween, the intermediate transfer belt 110 transports the four-color image to the secondary transfer nip. When the registration rollers 49 forwards the transfer sheet timely so that the transfer sheet laps over the four-color image in the secondary transfer nip, the four-color image is transferred from the intermediate transfer belt 110 onto a first side of the transfer sheet in the secondary transfer nip. This image becomes a full-color image (hereinafter also "toner image") on the white transfer sheet. Subsequently, the transport belt 24 transports the transfer sheet to the fixer 25.

The fixer 25 includes a belt unit including a fixing belt 26 looped around two rollers, and a pressure roller 27 that presses against one of those rollers. The fixing belt 26 contacts the pressure roller 27, forming a fixing nip in which the transfer sheet forwarded by the transport belt 24 is sandwiched. A heat source is provided inside the roller against which the fixing roller 27 presses so as to heat the fixing belt 26, which heats the transfer sheet. Thus, the full-color image is fixed on the transfer sheet with heat from the transfer belt 26 and a nip pressure.

Then, the transfer sheet whose first side carries the fixed toner image is either stacked on a stack part 57 provided outside a side plate of the print unit 150 on the left in FIG. 1 or returned to the secondary transfer nip so that a toner image is formed on a second side thereof in the duplex print mode.

A copying operation using the copier 100 is described below with reference to FIG. 1.

For example, a stack of original documents is set on a document table 30 of the ADF 400. Alternatively, when the original documents are bound like a book, the ADF 400 is lifted to expose a contact glass 32 of the scanner 300, the original documents are set on the contact glass 32, and then the ADF 400 is lowered to hold the original documents.

Then, when a user presses a start switch, the ADF 400 forwards the original documents set on the document table 30 one by one onto the contact glass 32, and then the scanner 300 starts reading image information of the original documents. When the original documents are set on the contact glass 32, pressing the start switch causes the scanner 300 to immediately read the original documents.

The scanner 300 includes a first carriage 33 including a light source, a second carriage 34 including a mirror, an imaging lens 35, and a reading sensor 36. In a document reading operation, both the first carriage 33 and the second carriage 34 start traveling, and the light source emits light toward the original document. The light is then reflected by the original document, and the mirror in the second carriage 34 further reflects the light to the imaging lens 35. After passing through the imaging lens 35, the light enters the reading sensor 36, and thus the reading sensor 36 obtains image information based on the light.

In parallel to the document reading operation described above, components of the process cartridges 18, the intermediate transfer unit 17, the secondary transfer unit 22, and the fixer 25 are activated. The optical writing unit 21 is controlled so as to form electrostatic latent images for yellow, magenta, cyan, and black on the photoreceptors 1Y, 1M, 1C, and 1K, respectively, according to the image information obtained by the reading sensor 36. Then, the latent images are developed into toner images and further transferred onto the intermediate transfer belt 110, forming a four-color image (toner image).

Further, simultaneously with the start of the document reading operation described above, the sheet feeder 200 starts to feed the transfer sheets. One of the feed rollers 42 is selected and rotates to feed the transfer sheets from the sheet cassette 44 corresponding thereto, and the transfer sheets are transported along the sheet feed path 46 one by one, separated by the separation roller 45. Alternatively, the transfer sheets can be fed from a manual feed tray 51. In this case, a manual feed roller 50 is selected to rotate, and the transfer sheets are transported along a manual feed path 53 one by one, separated by a separation roller 52.

When forming a multicolor image using at least two different color toners, the copier 100 holds an upper side of the intermediate transfer belt 110 substantially horizontally so as to contact all photoreceptors 1.

By contrast, when forming a monochrome image using only black toner, the upper side of the intermediate transfer belt 110 is disengaged from the photoreceptors 1Y, 1M, and 1C by inclining the intermediate transfer belt 110 so that its left side is lowered. Then, only the photoreceptor 1K is rotated counterclockwise in FIG. 1 and a black image is formed thereon. In each of the process cartridges 18Y, 18M, and 18C, the developing unit 4 is deactivated as well so as to save the developer and prevent wear of the photoreceptor 1.

Although not shown in FIG. 1, the copier 100 further includes a controller 198 for controlling operations of respective parts thereof and an operating unit (operation display)

194 including a display and various keys, and these are described below with reference to FIG. 16.

Regarding single print modes in which an image is formed only one side of the transfer sheet, the copier 100 can offer three different mode: a direct discharge mode, a reverse discharge mode, and a reverse decal discharge mode. The user can select one of the modes by sending a command to the controller 198 from the operating unit 194.

Figure 2:
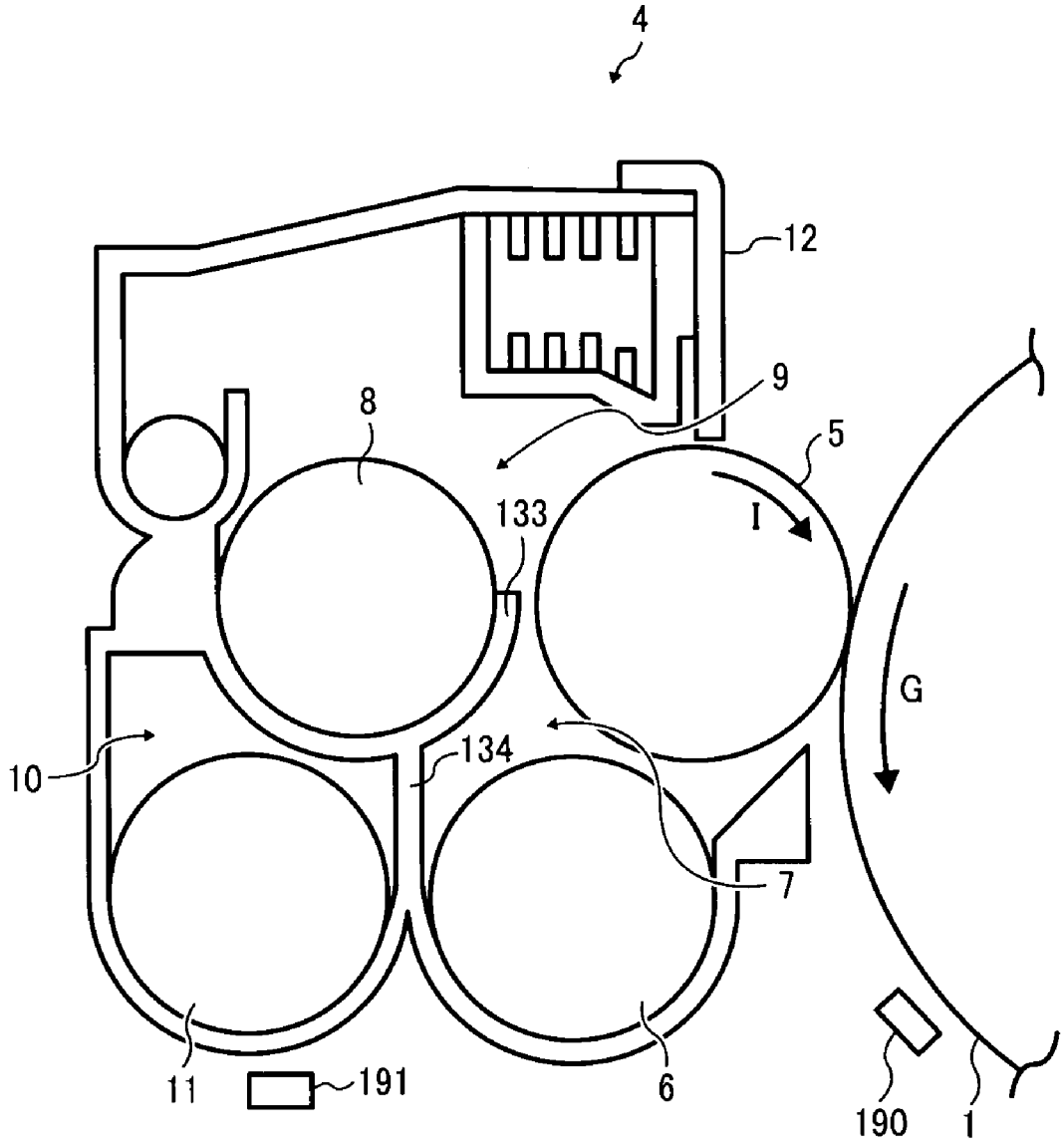
FIG. 2 schematically illustrates configurations of a developing unit and a photoreceptor.

FIG. 2 is an end-on view illustrating the developing unit 4 and the photoreceptor 1 included in each process cartridge 18 shown in FIG. 1.

Referring to FIGS. 1 and 2, while the photoreceptor 1 rotates in a direction indicated by arrow G, the charger charges the surface of the photoreceptor 1 and an electrostatic latent image is formed thereon with the laser light emitted from the optical writing unit 21. Further, the developing unit 4 supplies the latent image with the toner, forming a toner image.

As shown in FIG. 2, the developing unit 4 includes a developer container part and a developing roller 5 serving as a developer carrier that supplies the electrostatic latent image on the photoreceptor 1 with the toner while rotating in a direction indicated by arrow I.

The developer container part (hereinafter also "developer transport path") forms a collection path 7, a supply path 9, and an agitation path 10 provided with a collection screw 6, a supply screw 8, and an agitation screw 11, respectively. Each of the collection screw 6, the supply screw 8, and the agitation screw 11 serves as a developer transporter and a blade part is provided on its rotary shaft so as to transport the developer in an axial direction by rotating.

While supplying the toner to the developing roller 5, the supply screw 8 in the supply path 9 transports the developer toward a back side of the sheet on which FIG. 2 is drawn, that is, in a direction perpendicular to and rearward of the sheet on which FIG. 2 is drawn. The developer supplied to the developing roller 5 is adjusted to have a desired or given thickness by a developer doctor 12, serving as a developer regulator, located downstream from a portion where the developing roller 5 faces the supply screw 8 in the direction indicated by arrow I in which the developing roller 5 rotates (hereinafter also "developing roller rotational direction").

The collection path 7 is located downstream from a development area where the developing roller 5 faces the photoreceptor 1 in the developing roller rotational direction. The developing unit 4 further includes a development bias applicator configured to apply a developing bias for forming an electrical field that causes the toner to adhere to the electrostatic latent image on the photoreceptor 1.

The collection screw 6 collects the developer that has passed through the development area and transports the collected developer in a direction identical or similar to the direction in which the developer is transported (hereinafter simply "developer transport direction") by the supply screw 8.

The developing roller 5 and the supply path 9 are arranged laterally, and the collection path 7 is located beneath the developing roller 5.

The agitation path 10 including the agitation screw 11 is located beneath the supply path 9, parallel to the collection path 7. While agitating the developer, the agitation screw 11 transports the developer toward a front side of the sheet on which FIG. 2 is drawn, which is a direction opposite to the developer transport direction of the supply screw 8.

The developing unit 4 further includes a first separation wall 133 and a second separation wall 134, serving as separators, and a toner concentration sensor 191. The copier 100 further includes a toner adhesion sensor 190 serving as a toner adhesion detector. The first separation wall 133 includes a portion separating the supply path 9 from the agitation path 10 and a portion separating the supply path 9 from the collection path 7. The second separation wall 134 separates the collection path 7 from the agitation path 10.

For example, the toner adhesion detector 190 is located downstream from the development area in the direction indicated by arrow G in which the photoreceptor 1 rotates, and faces the photoreceptor 1 at a location in the axial direction that is within the width of the developing roller 5. The toner concentration sensor 191 is located on a bottom portion of the agitation path 10, in a downstream portion in the developer transport direction of the agitation screw 11, which is a back side portion in FIG. 2.

Circulation of the developer in the developing unit 4 is described below with reference to FIGS. 2 and 3.

Figure 3:
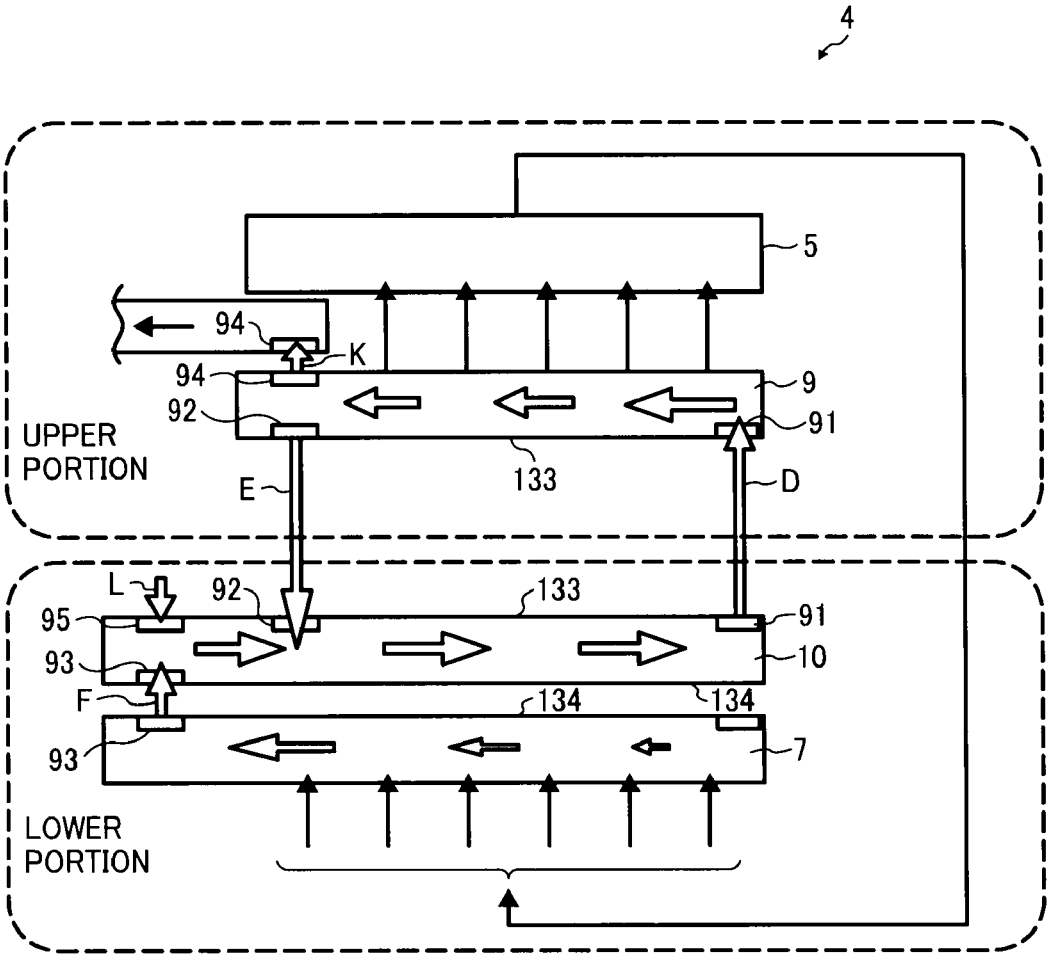
FIG. 3 schematically illustrates a flow of developer inside the developing unit shown in FIG. 2.

FIG. 3 illustrates a flow of the developer inside the developing unit 4, and arrows therein indicate directions in which the developer flows. Further, the back surface and the front side in FIG. 2 are located on the left and right in FIG. 3, respectively.

The first separation wall 133 includes openings 91 and 92, shown in FIG. 3, respectively provided in both end portions in the axial direction thereof, enabling the supply path 9 and the agitation path 10 to communicate with each other. The second separating wall 134 includes an opening 93 provided in an end portion on the left in FIG. 3 so as to connect the collection path 7 and the agitation path 10.

The developer that has passed through the development area is collected in the collection path 7 and transported to the left in FIG. 3. Subsequently, the developer is further transported to the agitation path 10 through the opening 93 of the first separation wall 133, which is located in a non-image area.

The first separation wall 133 has no opening in the portion separating the supply path 9 and the collection path 7, and thus the supply path 9 and the collection path 7 are kept separate and do not communicate with each other.

As shown in FIG. 3, a toner supply port 95 is provided in an upper portion of the agitation path 10 near the opening 93, and premixed toner including magnetic carrier is supplied to the agitation path 10 through the toner supply port 95 as indicated by arrow L, as needed.

The developer is transported from the agitation path 10 to the supply path 9 as indicated by arrow D in FIG. 3, where the supply screw 8 transports the developer downstream, that is, to the right in FIG. 3, while supplying the developing roller 5 with the toner. The developer that is not used for development (hereinafter also "excess developer") is transported to a downstream end portion of the supply path 9.

Then, the excess developer is transported to the agitation path 10 as indicated by arrow E through the opening 92 (hereinafter also "excess developer opening 92") provided on the first separation wall 133, located on the left in FIG. 3.

By contrast, the developer supplied to the developing roller 5 is collected in the collection path 7 as the developing roller 5 rotates, and then the collected developer (hereinafter also "used developer") is transported by the collection screw 6 to a downstream end portion of the collection path 7 located on the left in FIG. 3. The collected developer is further transported to the agitation path 10 as indicated by arrow F though the opening 93 (hereinafter also "collection opening 93") provided on the second separation wall 134.

Subsequently, in the agitation path 10, the agitation screw 11 agitates the excess developer and the collected developer as well as transports the agitated developer downstream, which is upstream in the developer transport direction of the supply screw 8. In a downstream end portion of the agitation path 10, the developer is supplied to the supply path 9 as indicated by arrow D through the opening 91 provided on the first separation wall 133 (hereinafter also "supply opening 91").

Thus, in the agitation path 10, the agitation screw 11 agitates and transports the collected developer, the excess developer, and the premixed toner (hereinafter also "unused toner") supplied through the toner supply port 95 in the opposite direction to the developer transport direction of the collection screw 6 and the supply screw 8. Then, the developer is transported from the downstream end portion of the agitation path 10 to an upstream portion of the supply path 9 that communicate with each other.

It is to be noted that the toner is supplied according to an output from the toner concentration sensor 191 that can be provided, for example, in a downstream portion of the agitation path 10.

As described above, the developing unit 4 shown in FIG. 3 includes the supply path 9 and the collection path 7 so that supply and collection of the developer can be performed in separate paths, preventing the used developer from entering the supply path 9 directly. Thus, the toner concentration in the developer to be supplied to the developing roller 5 does not decrease as the developer is transported downstream in the supply path 9.

Further, the developer 4 includes the collection path 7 and the agitation path 10 so that collection and agitation of the developer can be performed in separate paths, and thus the used developer can be fully mixed with the excess developer and the unused developer to supply well-agitated developer to the supply path 9.

Consequently, image density during development can be kept constant by maintaining the toner concentration in the developer as well as fully agitating the developer.

Location to supply the premixed toner to the developer transport path including the supply path 9, the agitation path 10, and the collection path 7 is described below in further detail.

Figure 4:
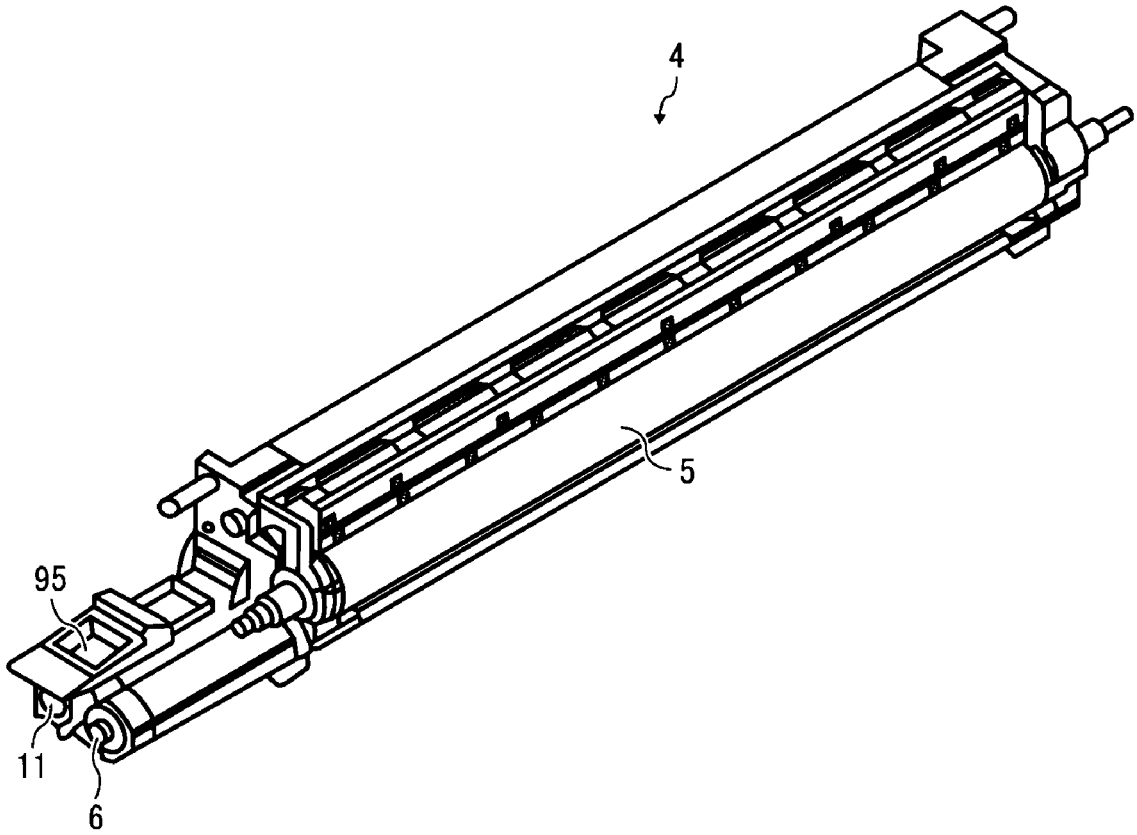
FIG. 4 is a perspective view illustrating the developing unit shown in FIG. 2.

FIG. 4 is a perspective view of the developer 4 shown in FIGS. 2 and 3.

With reference to FIGS. 3 and 4, the toner supply port 95 is located in the upper portion of an upstream end portion of the agitation path 10, which is outside an end portion of the developing roller 5 in the axial direction.

It is to be noted that the location of the toner supply port 95 is not limited to that described above, and alternatively, the toner supply port 95 may be provided on an upper portion of the downstream end portion of the collection path 7, for example. Alternatively, the toner supply port 95 may be provided above the collection opening 93 where the developer is transported from the collection path 7 to the agitation path 10. Because the newly supplied developer and the existing developer can be easily mixed together around the collection opening 93, the developer can be agitated more effectively by providing the toner supply port 95 there.

A toner supply unit to supply the premixed toner to the developing unit 4 through the toner supply port 95 is described below.

Figure 5:
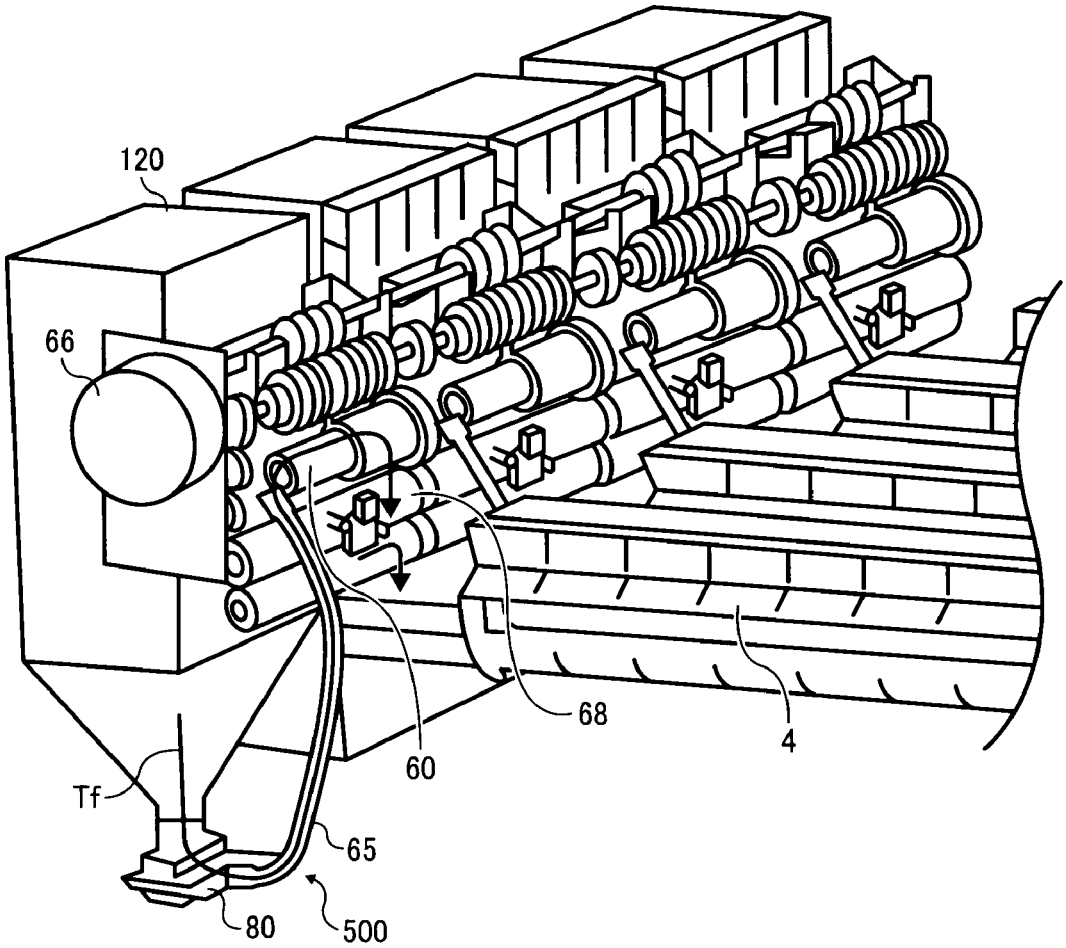
FIG. 5 is a perspective view illustrating a toner supply unit.
Figure 6:
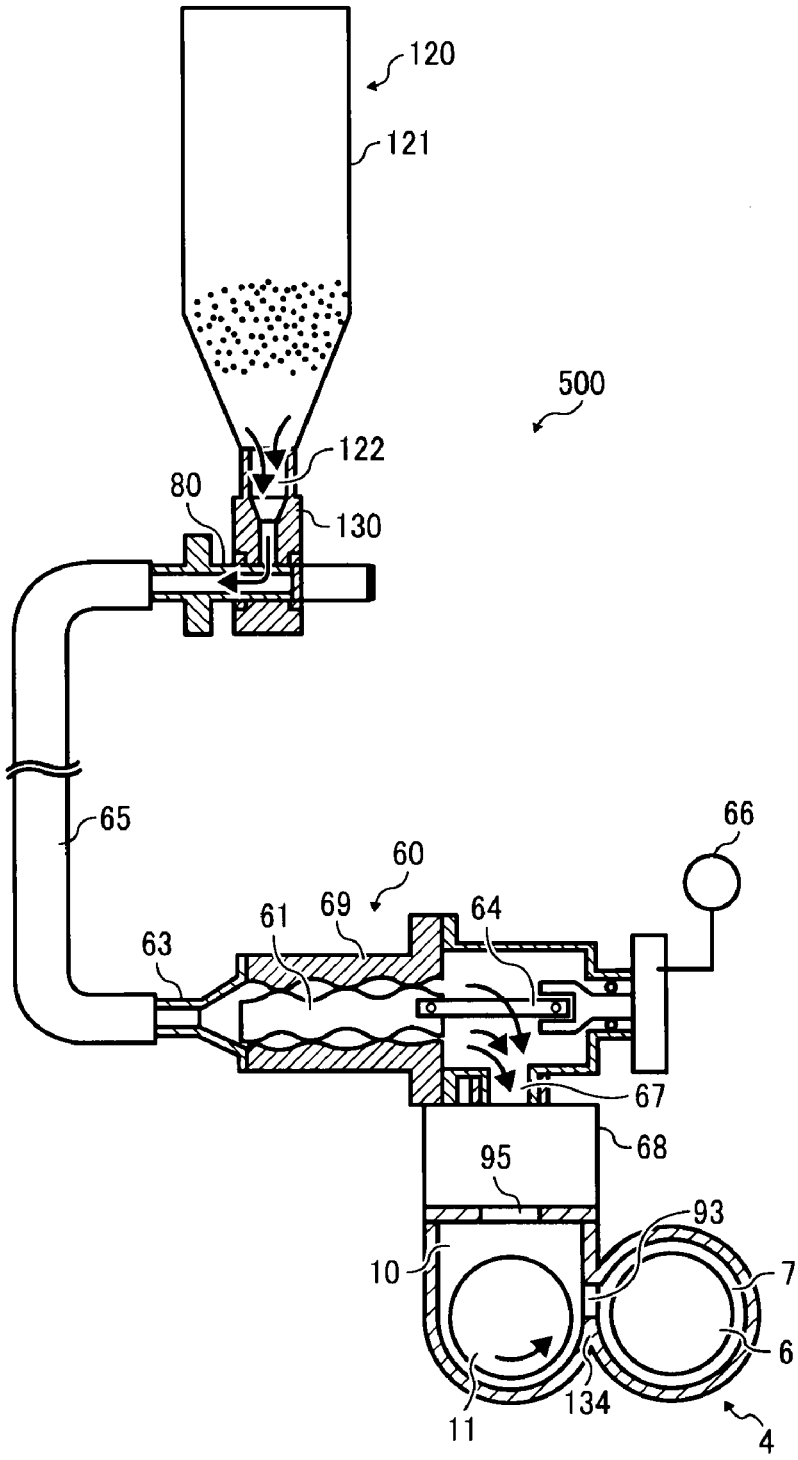
FIG. 6 is a cross section view illustrating the toner supply unit shown in FIG. 5.
Figure 7:
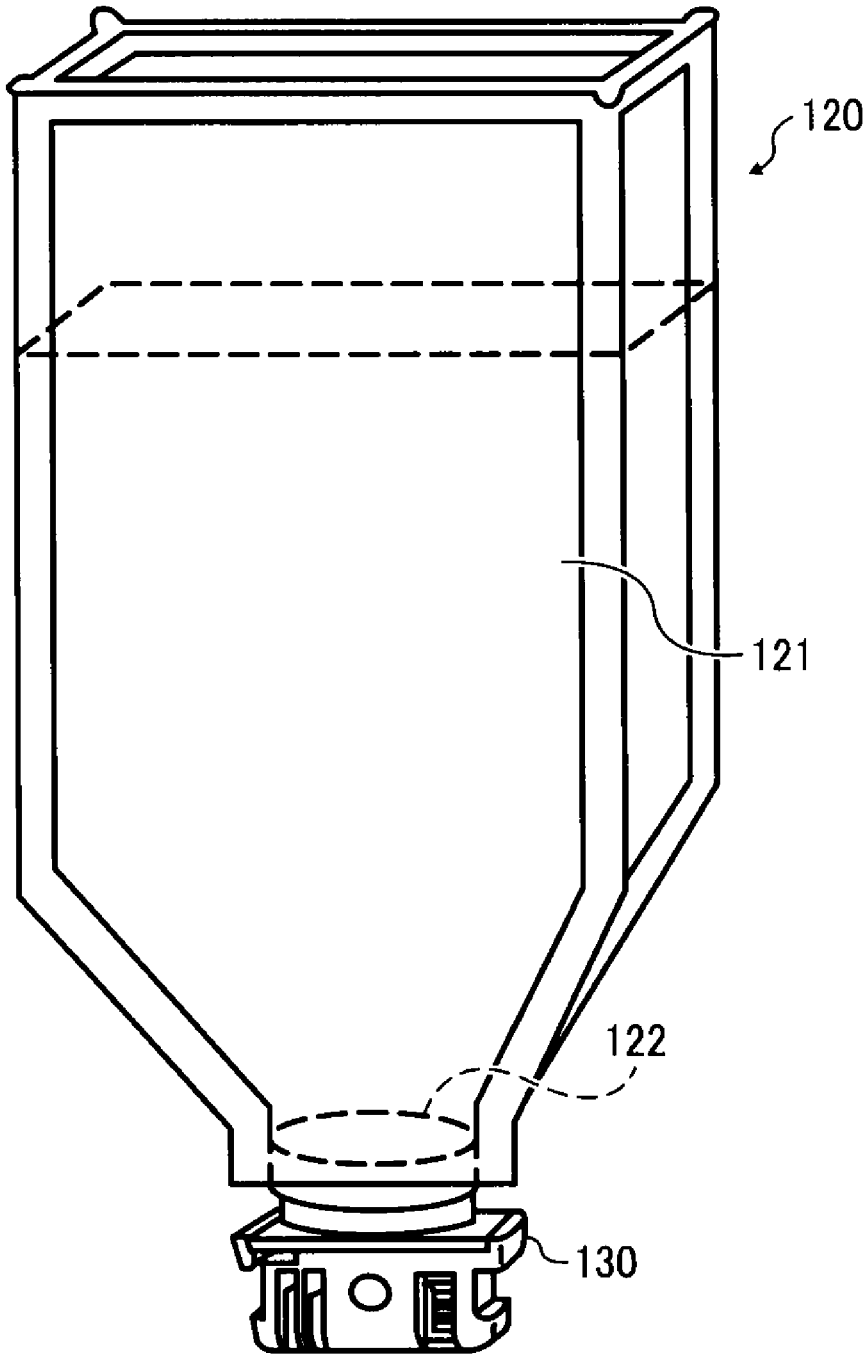
FIG. 7 is a perspective view illustrating a toner bottle.
Figure 8:
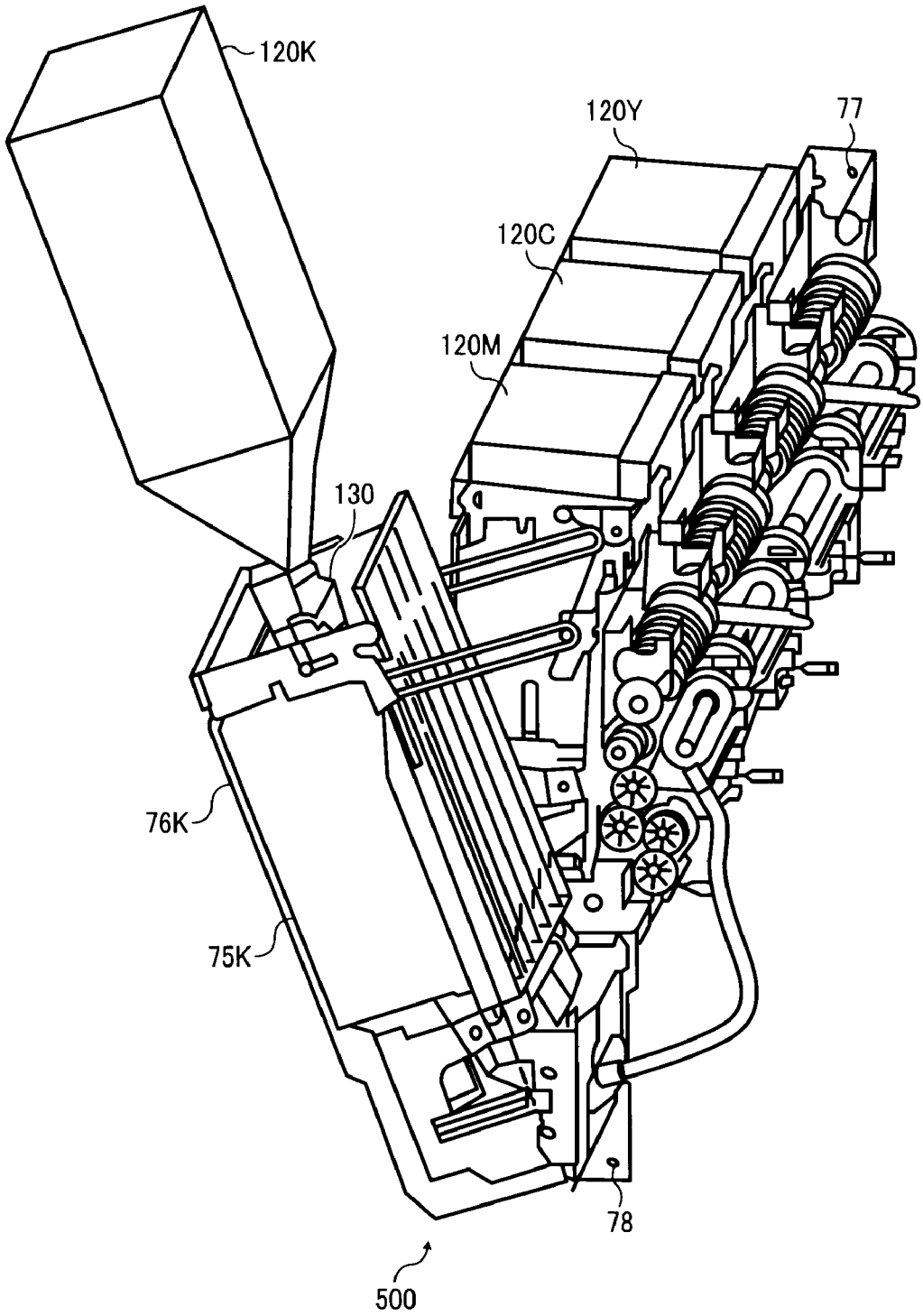
FIG. 8 illustrates setting of a black toner bottle on the toner supply unit shown in FIG. 5.
Figure 9:
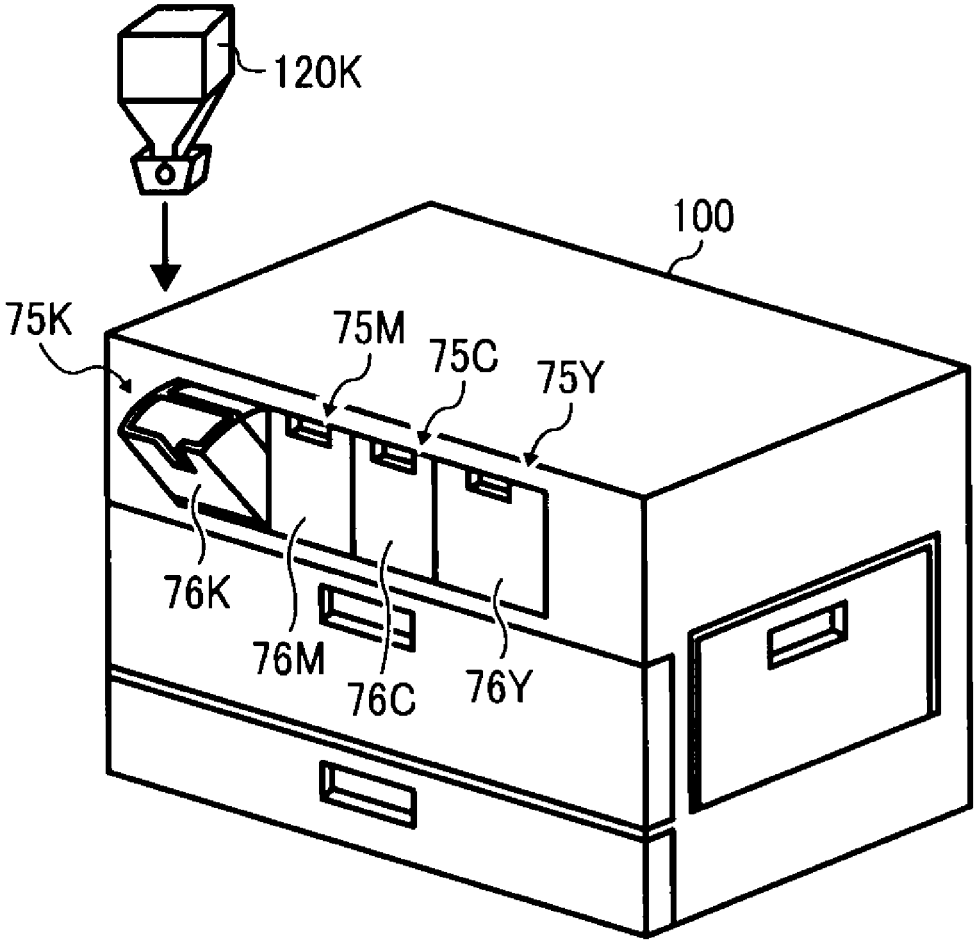
FIG. 9 is a perspective view of the image forming apparatus shown in FIG. 1.

The copier 100 shown in FIG. 1 further includes a toner supply unit 500. FIG. 5 is a perspective view illustrating the toner supply unit 500 including multiple toner bottles 120 serving as toner containers or powder containers, and FIG. 6 is a schematic illustration of a configuration thereof. Further, FIG. 7 is a perspective view illustrating the toner bottle 120, FIG. 8 illustrates installation of the toner bottle 120, and FIG. 9 is a perspective view of the copier 100.

Referring to FIG. 5, each toner bottle 120 contains the premixed toner including the toner and the carrier. The toner concentration of the premixed toner is higher than that of the developer in the developing unit 4. In FIG. 5, reference character $T_f$ indicates a flow of the premixed toner.

As shown in FIG. 5, the multiple toner bottles 120 for respective colors are arranged in the copier 100 that is a tandem image forming apparatus. The toner supply unit 500 further includes supply units each including a toner pump 60, a toner supply tube 65, and a sub hopper 68 for each color, and each toner bottle 120 is connected to the supply unit. The developing unit 4 is located beneath the supply unit. The toner supply unit 500 further includes a nozzle 80 for each color whose tip portion is inserted into the toner bottle 120, and each toner pump 60 is connected to a driving motor 66.

As shown in FIG. 6, the toner supply unit 500 further includes a suction port 63, a universal joint 64, and a toner outlet 67. The toner pump 60 in the present embodiment is either a mohno-pump, which is a type of screw pump, or a suction-type uniaxial eccentric screw pump, and includes a rotor 61 and a cylindrical stator 69 whose inner surface includes a spiral groove as main components. The rotor 61 is the shape of a shaft having a circular cross-section twisted into a spiral, and is connected to the driving motor 66 via a driving transmission and the universal joint 64. The rotor 61 transports the premixed toner axially by rotating inside the stator 69. The stator 69 is elastic and includes a hole whose cross-section is an ellipse twisted into a spiral. The pitch of the spiral of the stator 69 is twice that of the spiral of the rotor 61.

By engaging the rotor 61 with the stator 69 and then rotating the rotor 61, the premixed toner is transported through a space formed between the rotor 61 and the stator 69. In other words, in the toner pump 60, one of the main components is caused to slidably move as the other main component is rotated, generating a negative pressure at the suction port 63, which causes airflow inside the toner supply tube 65.

More specifically, when the rotor 61 is rotated, the premixed toner in the toner bottle 120 enters the toner pump 60 through the suction port 63, is aspirated and transported from the left to the right in FIG. 6, and then supplied to the developing unit 4 through the toner outlet 67, the sub hopper 68, and the toner supply port 95.

It is to be noted that the configuration of the toner pump 60 is not limited to the description above, and various known pumps such as those disclosed in Japanese Patent Publication No. 2000-098721 can be used, the contents of which are hereby incorporated by reference herein.

Referring to FIGS. 6 and 7, each toner bottle 120 includes a toner container 121, a toner outlet coupling 122 serving as a single powder outlet, and a base 130 attached to the toner outlet coupling 122.

Referring to in FIGS. 8 and 9, the toner supply unit 500 further includes four bottle holders 75Y, 75M, 75C, and 75K, each of which can pivot on a rotary shaft so as to partly disengage from the toner supply unit 500. As shown in FIG. 9, outer side surface 76Y, 76M, 76C, and 76K of the bottle holders 75Y, 75M, 75C, and 75K are exposed on a front side of the copier 100. The bottle holders 75Y, 75M, 75C, and 75K hold the toner bottles 120Y, 120M, 120C, and 120K, respectively. The toner supply unit 500 further includes multiple screw holes 77 and 78 into which screws are respectively inserted, attaching the toner supply unit 500 to the side walls of the copier 100.

Setting of the toner bottle 120 on the bottle holder 75 is described below.

Referring to FIGS. 6 and 8, for example, to set the toner bottle 120K on the bottle holder 75K, the user unlocks and pivots the bottle holder 75K so that the bottle holder 75K rotates down and out on the front side of the copier 100. Then, the user holds the toner bottle 120K with the side of the base 130 facing down and inserts the toner bottle 120K down the bottle holder 75K.

When the toner bottle 120 is on the bottle holder 75, the tip portion of the nozzle 80, which serves as a connecter of the copier 100 to be connected to the base 130, is inserted into the toner bottle 120. Thus, the toner outlet coupling 122 and a toner inlet of the nozzle 80 communicate with each other. The nozzle 80 includes a joint to be connected to the toner supply tube 65 that communicates with the toner pump 60, and further, the toner pump 60 communicates with the developing unit 4 via the sub hopper 68. Thus, when the toner bottle 120 is set on the bottle holder 75, the toner bottle 120 communicates with the developing unit 4.

Next, a disengagement mechanism to disengage the intermediate transfer belt 110 from the photoreceptors 1 is described below.

Figure 10:
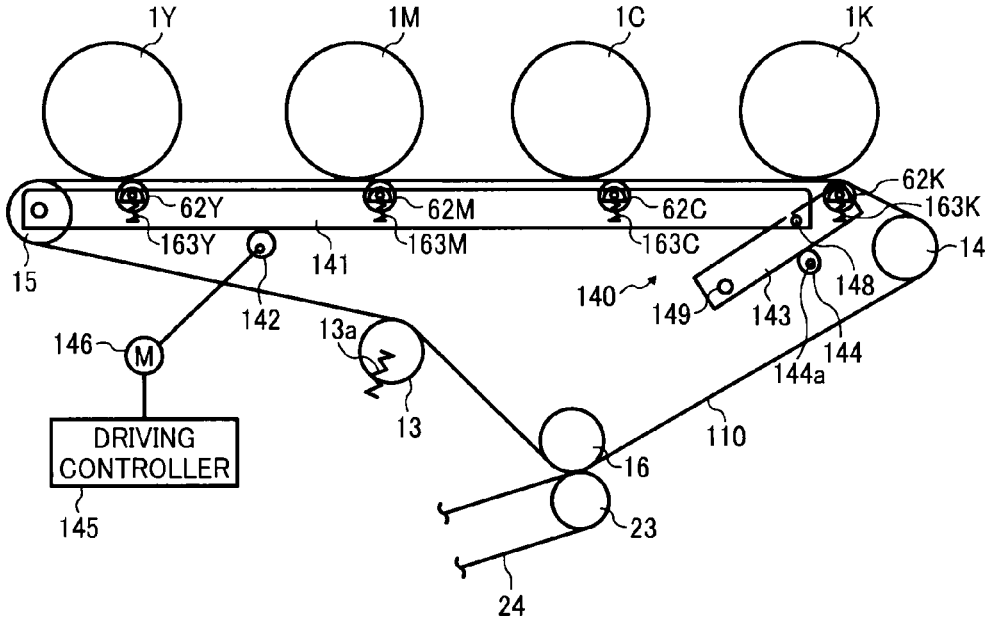
FIG. 10 illustrates a full engagement mode in which an intermediate transfer belt contacts all photoreceptors.

FIG. 10 illustrates a full engagement mode, in which the intermediate transfer belt 110 supported by the multiple rollers contacts all the photoreceptors 1Y, 1M, 1C, and 1K.

Referring to FIG. 10, a disengagement unit 140 includes a first arm 141, a first disengagement cam 142, a second arm 143, a second disengagement cam 144, a driving controller 145, and a first disengagement motor 146. The first arm 141 and the first disengagement cam 142 are for engaging or disengaging the intermediate transfer belt 110 with or from the photoreceptors 1Y, 1M, and 1C simultaneously, and the second arm 143 and the second disengagement cam 144 are for engaging or disengaging the intermediate transfer belt 110 with or from the photoreceptor 1K. The first disengagement cam 142 is rotated by the first disengagement motor 146 according to a control signal from the driving controller 145. The second disengagement cam 144 can be manually rotated using a lever 147 (shown in FIG. 14) that is attached to a tip portion of a shaft 144*a* of the second disengagement cam 144.

Figure 11:
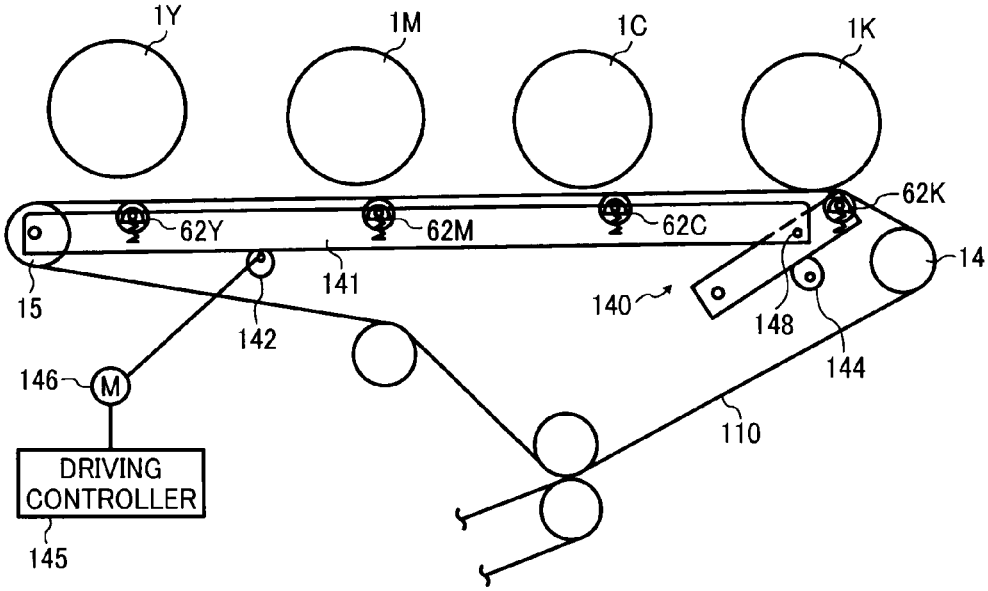
FIG. 11 illustrates a partial disengagement mode in which the intermediate transfer belt contacts only the photoreceptor for black.
Figure 12:
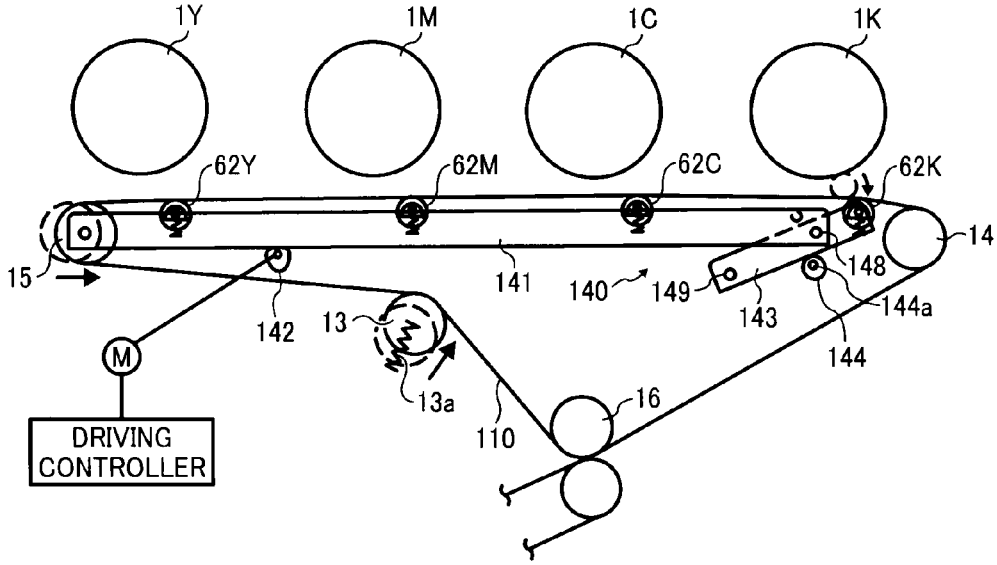
FIG. 12 illustrates a full disengagement mode in which the intermediate transfer belt is disengaged from all photoreceptors.

It is to be noted that hereinafter the right and the left sides of the first arm 141 in FIGS. 10 through 12 are simply referred to as the right and the left sides of the first arm 141.

An end portion of the first arm 141 is pivotally supported by a pivot point 148 provided on the second arm 143, and the location of the pivot point 148 is closer to the primary transfer roller 62K than a center portion of the second arm 143 in a longitudinal direction is. The second arm 143 is pivotally supported by a pivot point 149, and the pivot point 148 provided on the second arm 143 swings as the second arm 143 pivots.

The driving roller 15 is provided on a left end portion of the first arm 141, which is the side opposite the pivot point 148. Further, the primary transfer rollers 62Y, 62M, and 62C are located between the driving roller 15 and the pivot point 148 in a longitudinal direction of the first arm 141, and rotatably supported and biased toward the photoreceptors 1Y, 1M, and 1C simultaneously by pressure springs 163Y, 163M, and 163C, respectively. A tension spring 13*a* biases a tension roller 13 provided to contact the intermediate transfer belt 110 from outside so as to tension the intermediate transfer belt 110.

The first disengagement cam 142 contacts a portion of the first arm 141 located between the driving roller 15 and a center portion thereof in the longitudinal direction, on the side opposite the side of the primary transfer rollers 62Y, 62M, and 62C. As the first disengagement cam 142 rotates, the first arm 141 pivots on the pivot point 148, which causes the primary transfer roller 62Y, 62M, and 62C to engage or disengage the intermediate transfer belt 110 with or from the photoreceptors 1Y, 1M, and 1C simultaneously.

The second arm 143 is pivotally attached to a frame of the intermediate transfer unit 17 shown in FIG. 1 by the pivot point 149 provided on one portion thereof. The primary transfer roller 62K is located on another end portion of the second arm 143 on the side opposite the pivot point 149, and a pressure spring 163 rotatably supports the primary transfer roller 62K, as well as biasing it toward the photoreceptors 1K. The second disengagement cam 144 contacts the second arm 143 at a position between the primary transfer roller 62K and the center portion in the longitudinal direction, on the side opposite the side of the photoreceptor 1K. As the second disengagement cam 144 rotates, the second arm 143 pivots on the pivot point 149, which causes the primary transfer roller 62K to engage or disengage the intermediate transfer belt 110 with or from the photoreceptor 1K.

FIG. 11 illustrates a partial disengagement mode, in which the intermediate transfer belt 110 engages only the photoreceptor 1K and is disengaged from the photoreceptors 1Y, 1M, and 1C.

When the first disengagement cam 142 makes a half revolution from the state illustrated in FIG. 10, the first arm 141 pivots around the pivot point 148 downward in FIG. 10, and thus the primary transfer rollers 62Y, 62M, and 62C move away from the photoreceptors 1Y, 1M, and 1C, respectively. In this state, the second disengagement cam 144 is at an engagement position so as to press the primary transfer roller 62K against the photoreceptor 1K via the intermediate transfer belt 110. Accordingly, the intermediate transfer belt 110 disengages from the photoreceptors 1Y, 1M, and 1C and engages only the photoreceptor 1K as shown in FIG. 11, and thus the intermediate transfer belt 110 enters the partial disengagement mode for forming monochrome black images.

In the partial disengagement mode, deterioration of the photoreceptors 1Y, 1M, and 1C can be prevented or reduced because the intermediate transfer belt 110 does not contact them. Further, the photoreceptors 1Y, 1M, and 1C can be deactivated, extending the life of the chargers, the developing units 4, and the drum cleaners therefor as well as the photoreceptors 1Y, 1M, and 1C.

FIG. 12 illustrates a full disengagement mode, in which the intermediate transfer belt 110 is disengaged from all the photoreceptors 1Y, 1M, 1C, and 1K.

When unused developer is supplied to an empty developing unit 4, the intermediate transfer belt 110 is disengaged from all the photoreceptors 1Y, 1M, 1C, and 1K in the present embodiment. The intermediate transfer belt 110 is set to the full disengagement mode at the factory, and, at the user's site, the maintenance person rotates the second disengagement cam 144 using the lever 147 (shown in FIG. 14) attached to the shaft 144*a* so as to set the intermediate transfer belt 110 to the partial disengagement mode shown in FIG. 11.

When the second disengagement cam 144 makes a half revolution from the engagement position illustrated in FIG. 11 to a disengagement position, the second arm 143 pivots on the pivot point 149 clockwise in FIG. 11, and accordingly the primary transfer roller 62K descends away from the photoreceptor 1K, disengaging the intermediate transfer belt 110 from the photoreceptor 1K. That is, the intermediate transfer belt 110 is disengaged from all the photoreceptors 1Y, 1M, 1C, and 1K.

Further, in this state, the first arm 141 is inclined so that its right side on which the pivot point 148 is provided is lowered because the right side end portion is supported by the second arm 143, and thus the first arm 141 moves downward in FIGS. 11 and 12 to a position parallel or substantially parallel to the position shown in FIG. 10.

It is to be noted that, if the pivot point 148 of the first arm 141 is not connected to the second arm 143 as in the configuration described above, the first arm 141 would be inclined to the lower left in FIG. 12, and thus the primary transfer roller 62C would be closest to the corresponding photoreceptor 1 among the primary transfer rollers 62Y, 62C, 62M, and 62K. Accordingly, the distance between the intermediate transfer belt 110 and the photoreceptor 1C would be shorter than the distance between the intermediate transfer belt 110 and either of the photoreceptors 1Y and 1M.

Replacement of the developer in the developing unit 4 is described below.

The developer in the developing unit 4 is replaced periodically because the developer, the carrier in particular, deteriorates over time while being used. Used developer is removed from the developing unit 4 and then unused developer is supplied to the empty developing unit 4.

The used developer is collected from the developing unit 4 as follows: Referring to FIGS. 1 and 4, first, the developing unit 4 is detached from the copier 100, and then the used developer is collected through the toner supply port 95.

Figure 16:
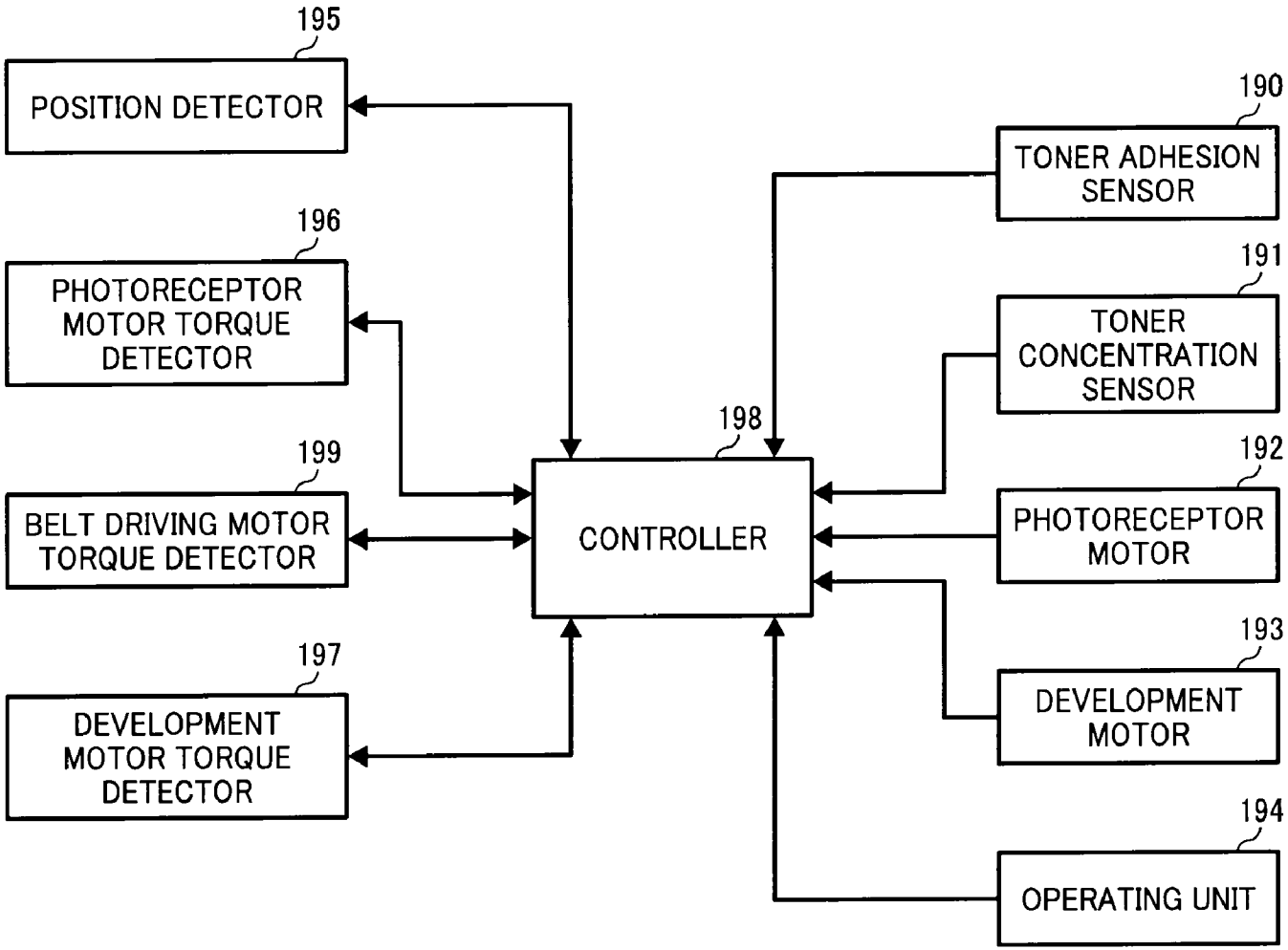
FIG. 16 is a block diagram illustrating main elements of electrical circuitry of the image forming apparatus shown in FIG. 1.

Alternatively, a developer outlet and a shutter to open/close this developer outlet can be provided on a bottom portion of the developing unit 4, and the copier 100 can be configured to offer a developer discharge mode that is selectable via the operating unit 194 (shown in FIG. 16). When this developer discharge mode is executed, for example, the shutter opens and each screw in the developing unit 4 starts rotating, discharging the used developer from the developing unit 4 through the developer outlet.

It is to be noted that, if the developing unit 4 is filled with the developer before shipment, and the copier 100 is shaken or tilts during transport, the developer might spill out from the opening of the developing unit 4. Further, the developer might deteriorate by being exposed to air. Therefore, the developer is supplied to the developing unit 4 at the user's site.

A developer supply operation is described below with reference to FIGS. 9 and 12 through 15.

Referring to FIG. 9, a front door is provided on the front side of the copier 100 so as to detach the toner supply unit 500 from the copier 100. First, the front door is opened and power to the copier 100 is turned off, after which the toner supply unit 500 is detached therefrom.

Figure 13:
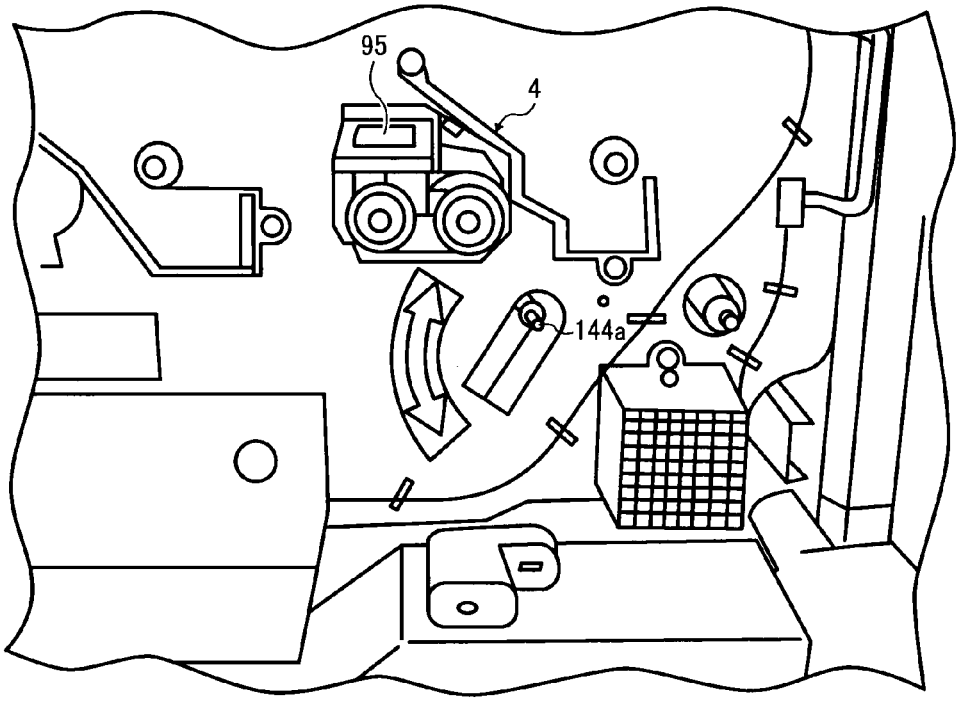
FIG. 13 illustrates the image forming apparatus from which the toner supply unit shown in FIG. 5 is removed.
Figure 14:
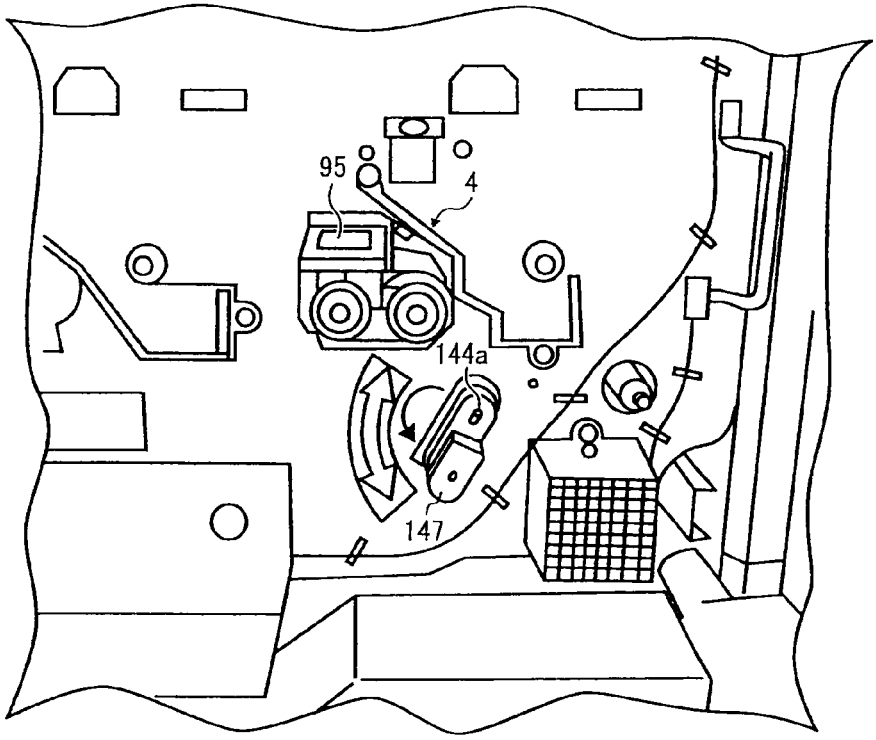
FIG. 14 illustrates a lever attached to a shaft of a second disengagement cam.

After the toner supply unit 500 is thus removed from the copier 100, the toner supply port 95 of each developing unit 4 appears as shown in FIG. 13. Subsequently, as shown in FIG. 14, the maintenance person attaches the lever 147 to the tip portion of the shaft 144*a* of the second disengagement cam 144, and then rotates the lever 147 counterclockwise in FIG. 14 so as to disengage the intermediate transfer belt 110 from all the photoreceptors 1Y, 1M, 1C, and 1K as shown in FIG. 12.

Figure 15:
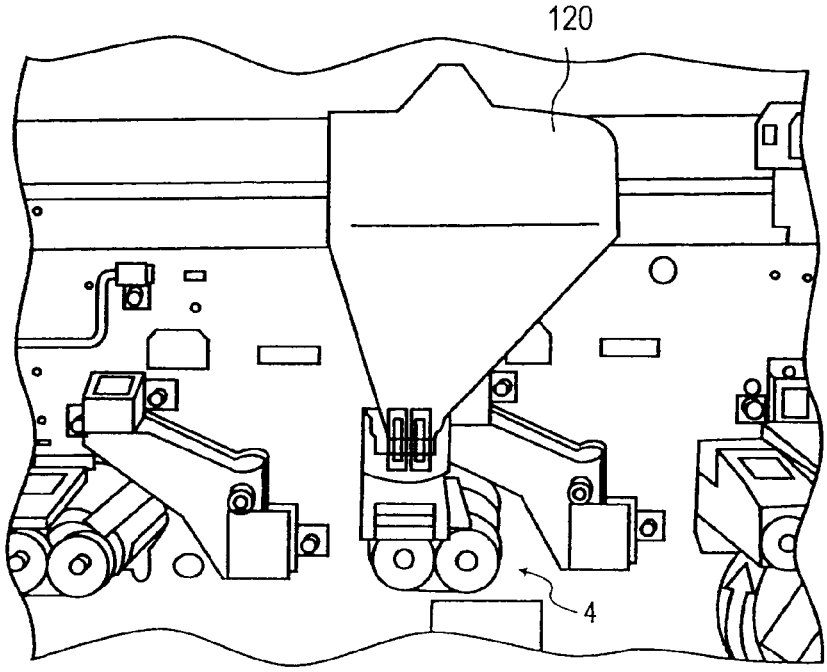
FIG. 15 illustrates a developer bottle set on a toner supply port of the developing unit shown in FIG. 2.

Then, referring to FIG. 15, the maintenance person attaches a toner bottle 120 serving as a developer container containing unused developer to the developing unit 4 so that a developer supply port of the toner bottle 120 engages the toner supply port 95.

In an initialization operation that is performed when the copier 100 arrives at the user's site, the toner bottles 120 for yellow, magenta, cyan, and black are respectively set on the toner supply ports 95 of the corresponding colors. In developer replacement work, a corresponding toner bottle 120 is set on the toner supply ports 95 of the developing unit 4 from which the used developer is removed.

Then, the maintenance person removes a heat seal covering the developer supply port of the toner bottle 120, closes the front door of the copier 100, and then turns on the power. Further, the maintenance person calls up a hidden menu via a display of the operating unit (operation panel) 194 (shown in FIG. 16), selects the color of the toner bottle 120 set on the developing unit 4, and then executes a developer supply mode. It is to be noted that the developer supply mode is performed for each color in the initialization operation.

When the developer supply mode is executed, each screw in the developing unit 4 starts rotating so as to transport and uniformly distribute the unused developer supplied from the toner bottle 120 in the developing unit 4.

It is to be noted that, while the developer supply mode is executed, the photoreceptor 1 can be rotated as well so as not to be damaged by newly supplied carrier adhered to the developing roller 5 (shown in FIG. 2). Further, because the cleaning blade (drum cleaner) might turn outward or inward if the photoreceptor 1 is kept rotating while the toner is not supplied thereto, a belt-shaped image can be formed on the photoreceptor 1 after a sufficient or given amount of the developer is supplied thereto so that the cleaning blade is supplied with the toner.

When all yellow, magenta, cyan, and black are selected in the developer supply mode, the yellow, magenta, cyan, and black developers are supplied, sequentially or simultaneously, to the respective developing units 4 in the present embodiment.

After all unused developer in the toner bottle 120 is supplied to the developing unit 4 and the developer supply mode is completed, the maintenance person turns the power off, opens the front door, and then attaches the toner supply unit 500 to the copier 100. Then the maintenance person closes the front door, turns on the power again, and then performs an initial setting operation to achieve a proper or desired image density. The initial setting operation includes calibrating the sensitivity of the toner concentration sensor 191 (shown in FIG. 2), setting image forming condition, etc.

The sensitivity of the toner concentration sensor 191 can be calibrated as follows: The unused developer contained in the toner bottle 120 has a predetermined or given toner concentration, and thus toner concentration in the developing unit 4 equals that value after the unused developer is supplied thereto. For example, the unused developer has a toner concentration of 7% in the present embodiment. Therefore, the sensitivity of the toner concentration sensor 191 is adjusted so that an output value thereof indicates a toner concentration of 7%.

Further, the image forming conditions are set as follows: Referring to FIG. 2, a predetermined or given test pattern is formed on the photoreceptor 1, and then the toner adhesion detector 190 detects the amount of the toner adhered to the test pattern. Based on results of the detection, development bias, charge bias, intensity of the exposure light, etc., are adjusted.

After the initial setting operation is completed, the maintenance person opens the front door of the copier 100, rotates the lever 147 shown in FIG. 14 so as to set the intermediate transfer belt 110 to the partial disengagement mode shown in FIG. 11 from the full disengagement mode shown in FIG. 12, and then closes the front door.

FIG. 16 is a block diagram illustrating main elements of control circuitry of the copier 100.

Referring to FIG. 16, the controller 198 includes a CPU (Central Processing Unit) serving as a computing unit, a nonvolatile RAM (Random Access Memory) serving as a data storage unit, a ROM (Read Only Memory) serving as another data storage unit, etc. The controller 198 is connected to the toner adhesion detector 190, the toner concentration sensor 191, a photoreceptor motor 192 that drives the photoreceptor 1, a development motor 193 that drives the developing unit 4, the operating unit 194, a position detector 195 that detects position of the intermediate transfer belt 110, a photoreceptor motor torque detector 196, a development motor torque detector 197, and a belt driving motor torque detector 199.

It is to be noted that, although the controller 198 performs overall control of the copier 100 and various devices and sensors are connected thereto, only the devices and the sensors that concern features of the copier 100 are shown in FIG. 16.

The controller 198 implements functions of the respective parts according to control programs stored in the RAM and the ROM. More specifically, when execution of the developer supply mode is instructed via the operating unit 194, the controller 198 drives the photoreceptor motor 192 and the development motor 193, thus serving as a developer supply controller.

As noted previously, in the developer supply operation described above, if unused developer is supplied to the developing unit 4 in which developer is present (redundant replenishment) due to human error, the copier 100 might be seriously contaminated or damaged.

Figure 17:
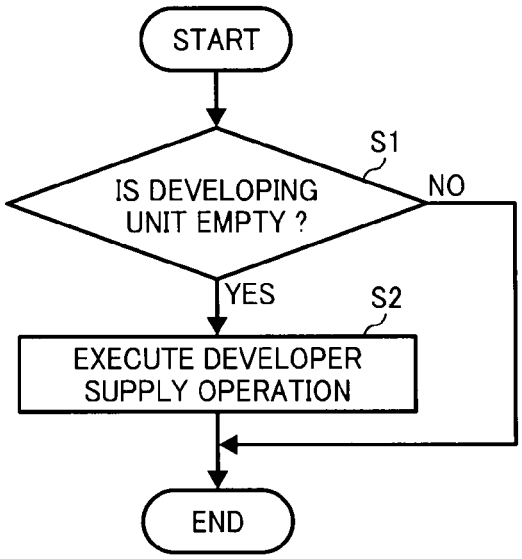
FIG. 17 illustrates a basic procedure to execute a developer supply mode.

In view of the foregoing, in a process whose steps are illustrated in the flow chart shown in FIG. 17, at S1 the controller 198 confirms that the developer container part of the developing unit 4 is empty, and then at S2 executes the developer supply mode only when the developer is not present therein, that is, the developing unit is empty (YES at S1) in order to prevent such human error.

The present embodiment is described below in further detail with reference to FIGS. 16 and 18.

Figure 18:
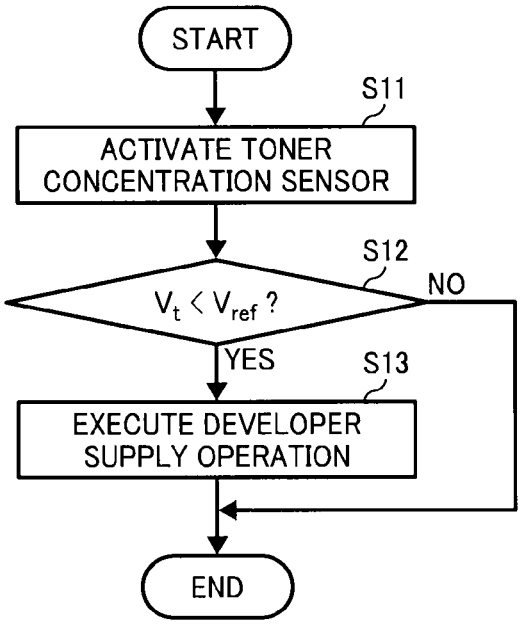
FIG. 18 illustrates a procedure to execute a developer supply mode using a toner concentration sensor.

FIG. 18 illustrates a procedure to execute the developer supply mode, in which the controller 198 checks for the presence of the developer in the developer container part of the developing unit 4 based on an output value $V_t$ from the toner concentration sensor 191 serving as a developer detector.

First, the maintenance person sets the toner bottle 180 (shown in FIG. 15) on the toner supply port 95 (shown in FIG. 14) of the developing unit 4, and then instructs the copier 100 to execute the developer supply mode via the operating unit 194. Subsequently, referring to FIG. 18, at S11 the controller 198 activates the toner concentration sensor 191 that in the present embodiment is a magnetic permeability sensor, and at S12 checks whether or not an output value $V_t$ therefrom is lower than a predetermined or given threshold $V_{ref}$.

When the toner concentration in the developing unit 4 is lower, that is, a relatively large amount of the carrier is present in an area detected by the toner concentration sensor 191, magnetic permeability thereof is relatively high, and accordingly the output value $V_t$ is higher. By contrast, when the toner concentration in the developing unit 4 is higher, that is, a relatively small amount of the carrier is present in the area detected by the toner concentration sensor 191, magnetic permeability thereof is lower, and accordingly the output value $V_t$ is lower.

In other words, when the developing unit 4 is empty, the output value $V_t$ as well as the magnetic permeability therein are significantly low. Therefore, when the output value $V_t$ of the toner concentration sensor 191 is lower than the threshold $V_{ref}$ (YES at S12), the developing unit 4 can be regarded as being empty. Then, at S13 the controller 198 executes the developer supply mode, driving the collection screw 6, the supply screw 8, the agitation screw 11 (developer transporters), etc., in the developing container part shown in FIG. 2.

By contrast, when the output value $V_t$ of the toner concentration sensor 191 is higher than the threshold value $V_{ref}$ (NO at S12), the controller 198 displays an error message on the operating unit 194, etc., and terminates the procedure. Thus, redundant replenishment of the developer can be prevented. Further, because the toner concentration detector 191 serves as the developer detector to detect presence of the developer in the developer container part of the developing unit 4, a separate developer detector is not required, saving both the number of components used in the copier 100 as well as the cost thereof.

Another illustrative embodiment is described below with reference to FIGS. 16 and 19.

Figure 19:
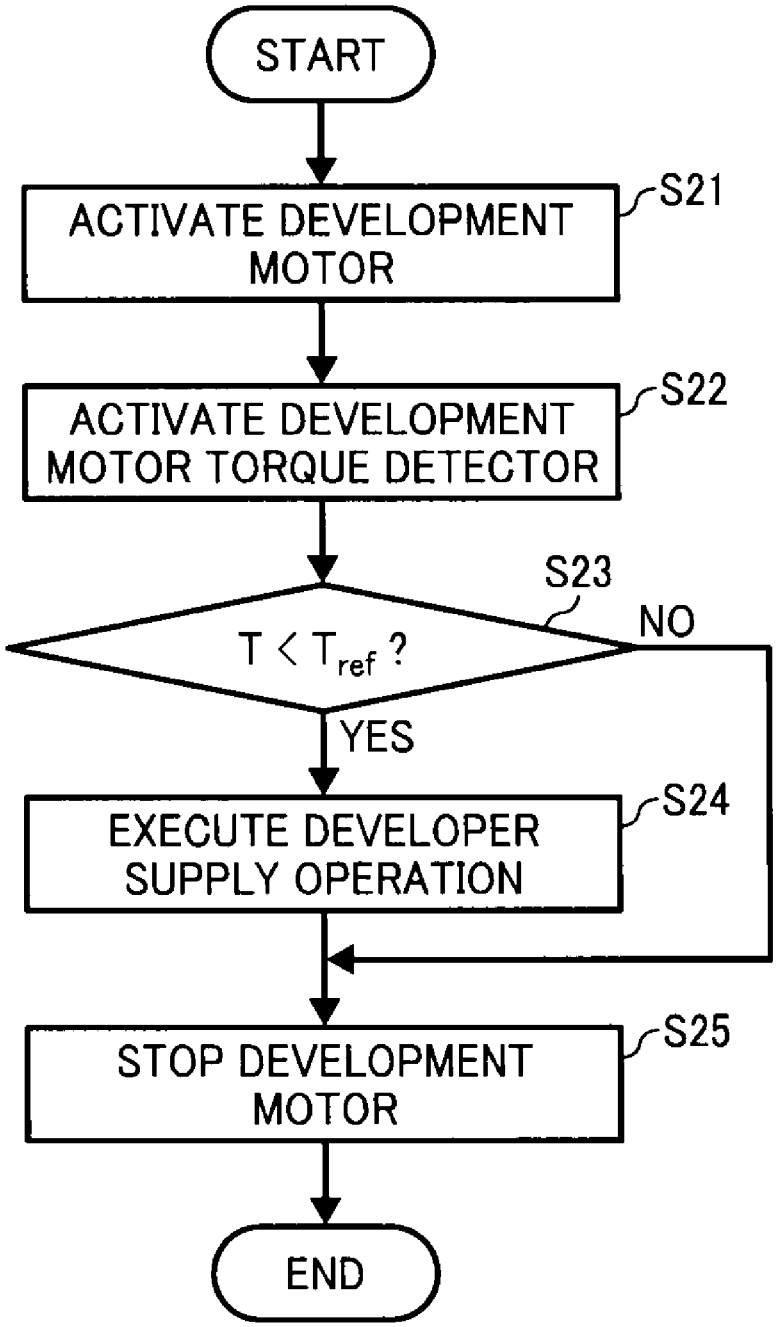
FIG. 19 illustrates a procedure to execute a developer supply mode using a development motor torque detector.

FIG. 19 illustrates another procedure to execute the developer supply mode, in which the presence of the developer in the developer container part is detected based on torque of the developer transporter or the development motor 193.

First, the maintenance person sets the toner bottle 120 (shown in FIG. 15) on the toner supply port 95 (shown in FIG. 14) of the developing unit 4, and then instructs the copier 100 to execute the developer supply mode via the operating unit 194. Subsequently, referring to FIG. 19, at S21 the controller 198 activates the development motor 193 so as to drive the developing roller 5, the collection screw 6, the supply screw 8, and the agitation screw 11 shown in FIG. 2.

At S22, the controller 198 activates the development motor torque detector 197 so as to detect torque of the development motor 193. The development motor torque detector 197 monitors a driving current of the development motor 193 and then converts it into torque, which is used to detect an abnormal state of the development motor 193 and the developing unit 4.

At S23, the controller 198 checks whether or not the detected torque T of the development motor 193 is lower than a predetermined or given threshold $T_{ref}$. Because the torques of the collection screw 6, the supply screw 8, and the agitation screw 11 are higher, and accordingly the detected torque T is higher when the developer is present in the developing unit 4, the presence of the developer can be detected based on the torque of the development motor 193.

When the detected torque T is higher than the threshold $T_{ref}$ (NO at S23), that is, the developer is present in the developer container part of the developing unit 4, the controller 198 displays an error message on the operating unit 194, etc., stops the development motor 193 at S25, and terminates the procedure.

By contrast, when the detected torque T is lower than the threshold $T_{ref}$ (YES at S23), that is, the developer is not present in the developer container part, at S24 the controller 198 executes the developer supply mode and then stops the development motor 193 at S25.

It is to be noted that, although the development motor 193 is driven so as to detect the torque, the developer does not spill over from the developing unit 4 even if the developer is already present therein because driving time of the development motor is very short, supplying a very small amount of the developer, if any.

As described above, redundant replenishment of the developer can be prevented as well in the present embodiment because, when the developer is present in the developing unit 4, the developer is not supplied from the toner bottle 120 thereto. Further, because the development motor 193 and the development motor torque detector 197 serve as the developer detector, a separate developer detector is not required, saving both the number of components used in the copier 100 as well as the cost thereof.

Another illustrative embodiment is described below with reference to FIGS. 16 and 20.

Figure 20:
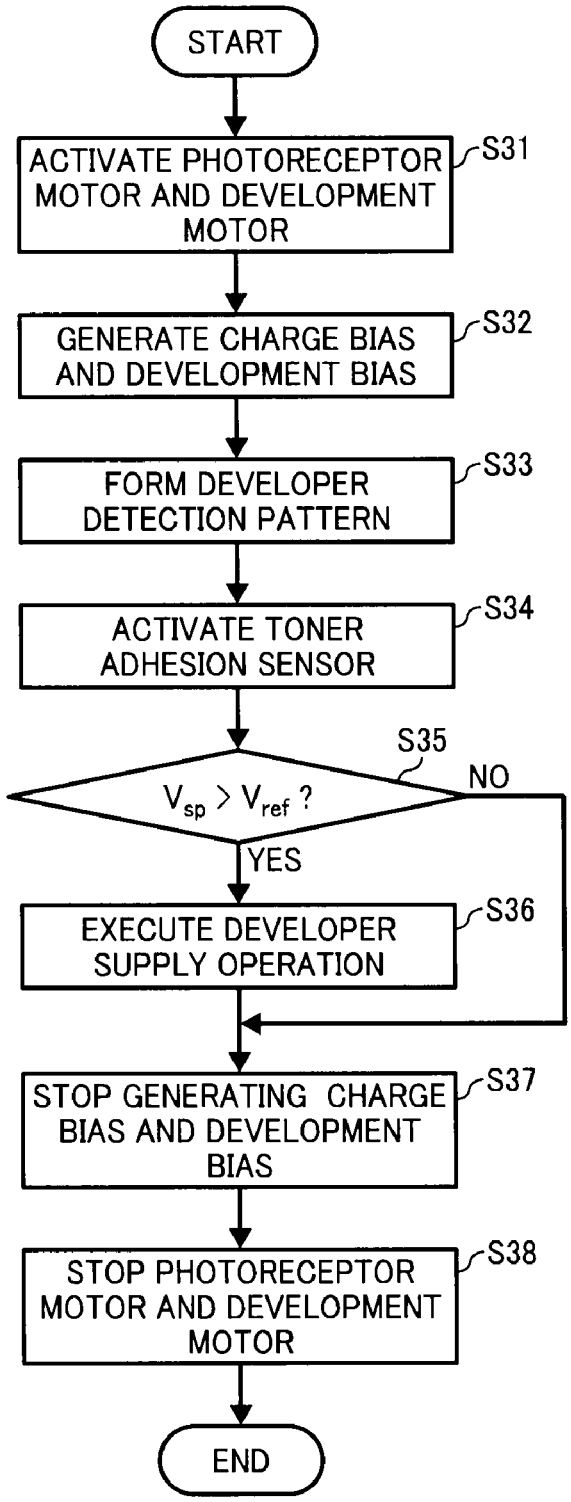
FIG. 20 illustrates a procedure to execute a developer supply mode using a toner adhesion detector.

FIG. 20 illustrates another procedure to execute the developer supply mode, in which a predetermined or given image is formed on the photoreceptor 1 as a developer detection pattern, the amount of the toner adhered to the developer detection pattern is detected, and then the presence of the developer in the developer container part is detected based on results of the detection.

First, the maintenance person sets the toner bottle 120 (shown in FIG. 15) on the toner supply port 95 (shown in FIG. 14) of the developing unit 4, and then instructs the copier 100 to execute the developer supply mode via the operating unit 194. Subsequently, referring to FIG. 20, at S31 the controller 198 activates the photoreceptor motor 192 and the development motor 193, and simultaneously, causes the charger and the development bias applicator to generate the charge bias and the development bias, respectively, at S32. Then, the developer detection pattern is formed on the photoreceptor 1 at S33, and then the controller 198 activates the toner adhesion detector 190 to detect the developer detection pattern at S34. At S35, the controller 198 checks whether or not an output value Vsp of the toner adhesion detector 190 is higher than a predetermined or given threshold Vref at S35.

The toner adhesion detector 190 in the present embodiment is a reflection optical sensor, and the output value $V_{sp}$ is lower when the amount of the toner adhered to the photoreceptor 1 is larger and higher when the amount of the toner adhered to the photoreceptor 1 is smaller. When the developer is not present in the developing unit 4, the toner does not adhere to the developer detection pattern on the photoreceptor 1, and accordingly the output value $V_{sp}$ is higher than the threshold $V_{ref}$.

Therefore, when the output value $V_{sp}$ is higher than the threshold $V_{ref}$ (YES at S35), the controller 198 executes the developer supply mode at S36. By contrast, when the output value $V_{sp}$ is lower than the threshold $V_{ref}$ (NO at S35), that is, there is some toner adhered to the developer detection pattern, the controller 198 determines that the developer is present in the developing unit 4. Consequently, the controller 198 displays an error message on the operating unit 194, etc.

Then, the controller 198 turns off the charger and the development bias applicator at S37, and further turns off the photoreceptor motor 192 and the development motor 193 at S38.

It is to be noted that, although the development motor 193 is driven so as to form the developer detection pattern, the developer does not spill over from the developing unit 4 even if the developer is already present therein because driving time of the development motor is very short, supplying a very small amount of the developer, if any.

As described above, redundant replenishment of the developer can be prevented as well in the present embodiment because, when the developer is present in the developing unit 4, the developer is not supplied from the toner bottle 120 thereto. Further, because the toner adhesion detector 190 serves as the developer detector, a separate developer detector is not required, saving both the number of components used in the copier 100 as well as the cost.

A procedure to execute the developer supply mode according to another illustrative embodiment is described below with reference to FIGS. 21 though 23.

If the maintenance person forgets to disengage the intermediate transfer belt 110 from the photoreceptors 1 before executing the developer supply mode, the intermediate transfer belt 110 might rub against the photoreceptors 1, damaging the surfaces thereof. Therefore, in the present embodiment, the controller 198 checks whether or not the intermediate transfer belt 110 is disengaged therefrom before executing the developer supply mode as shown in FIG. 21.

Figure 21:
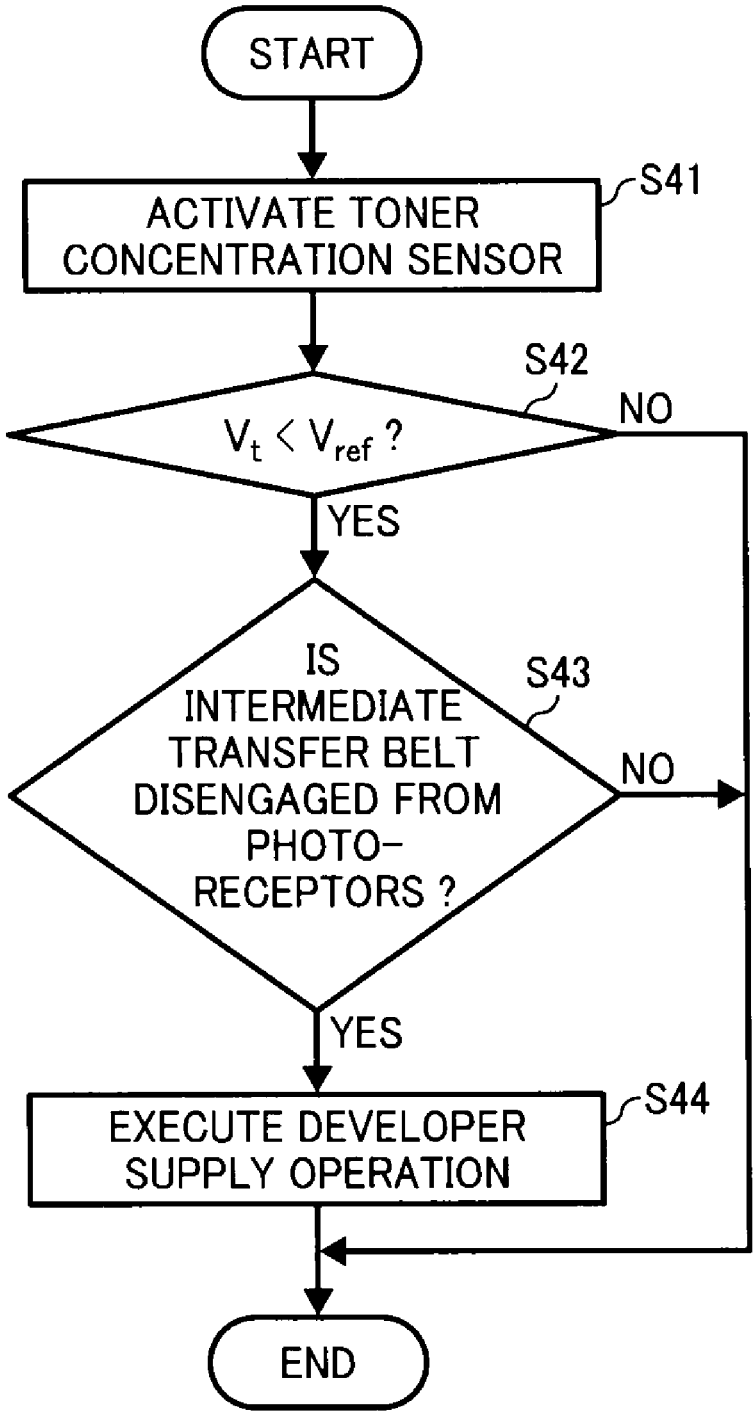
FIG. 21 illustrates a basic procedure to execute a developer supply mode including detection of a position of the intermediate transfer belt.

Referring to FIG. 21, at S41 the controller 198 activates the toner concentration sensor 191, and checks whether or not the output value $V_t$ is lower than the threshold $V_{ref}$ so as to confirm that the developer is not present in the developing unit 4 at S42. When the output value $V_t$ is lower than the threshold $V_{ref}$ (YES at S42), the controller 198 checks whether or not the intermediate transfer belt 110 is disengaged from the photoreceptors 1 at S43. After confirming that the intermediate transfer belt 110 is disengaged from the photoreceptors 1 (YES at S43), the controller 198 executes the developer supply mode at S44.

It is to be noted that, alternatively, presence of the developer may be determined based on the amount of the toner adhered to the photoreceptor 1 or the torque of one of the development motor 193 and the photoreceptor motor 192 as described above.

Further, the procedure described above is performed when black or all colors is selected in the developer supply mode because the partial disengagement mode shown in FIG. 11 is set as the default mode in the present embodiment.

This procedure is described in further detail below.

Figure 22A:
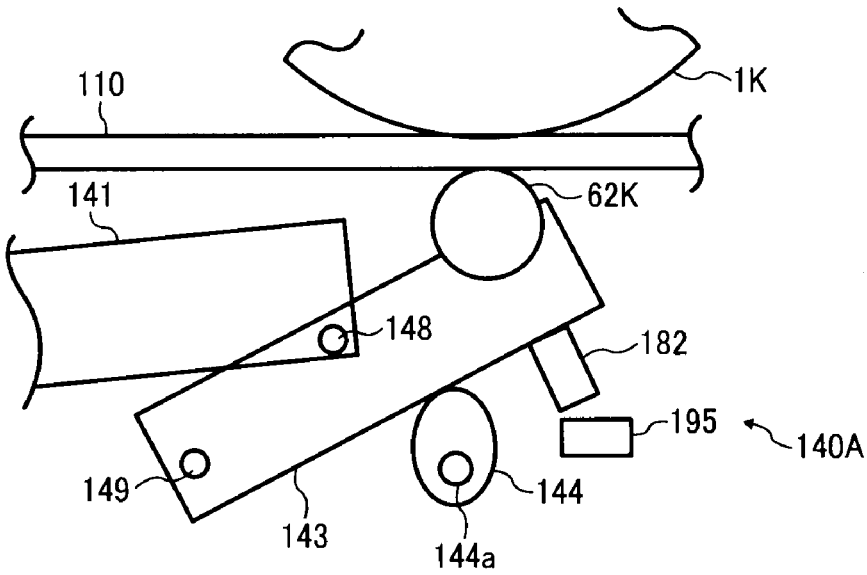
FIGS. 22A and 22B illustrate a disengagement detector according to an illustrative embodiment.

Referring to FIG. 22A, a disengagement unit 140A according to the present embodiment includes a filler 182 protruding from a bottom surface of the second arm 143 and a position detector 195 as a disengagement detector to detect disengagement between an intermediate transfer belt 110 and photoreceptors 1. Other than that, the disengagement unit 140A has a configuration similar to that of the disengagement unit 140 shown in FIG. 10, and thus a description thereof is omitted.

The position detector 195 in the present embodiment is a transmissive optical sensor including a light emitting element and a light receiving element arrayed to face each other at a predetermined or given distance apart, and detects a position of the intermediate transfer belt 110.

In the partial disengagement mode shown in FIG. 22A, in which the second disengagement cam 144 is at the engagement position to engage the intermediate transfer belt 110 with the photoreceptor 1K, the light receiving element receives light emitted from the light emitting element, and the position detector 195 outputs a predetermined or given value.

By contrast, when the intermediate transfer belt 110 is disengaged from the photoreceptor 1K by rotating the second disengagement cam 144 to the disengagement position using the lever 147 shown in FIG. 14, the filler 182 moves to between the light emitting element and the light receiving element. In this state, the filler 182 interrupts the light emitted from the light emitting element, and the output value from the light receiving element decreases.

Thus, the position detector 195 can detect that the intermediate transfer belt 110 is disengaged from the photoreceptor 1K based on the rotational position of the second disengagement cam 144.

Figure 22B:
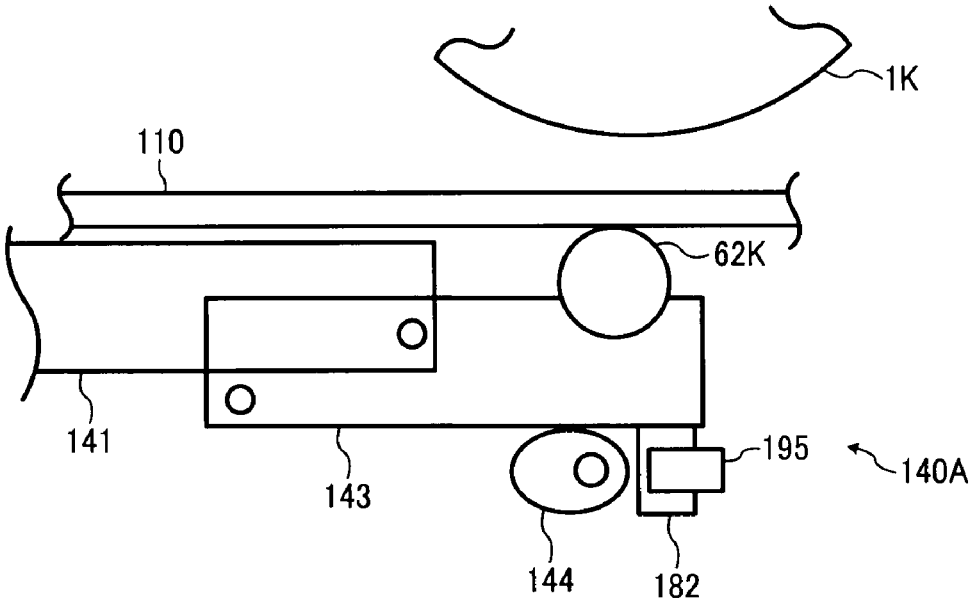
Figure 23:
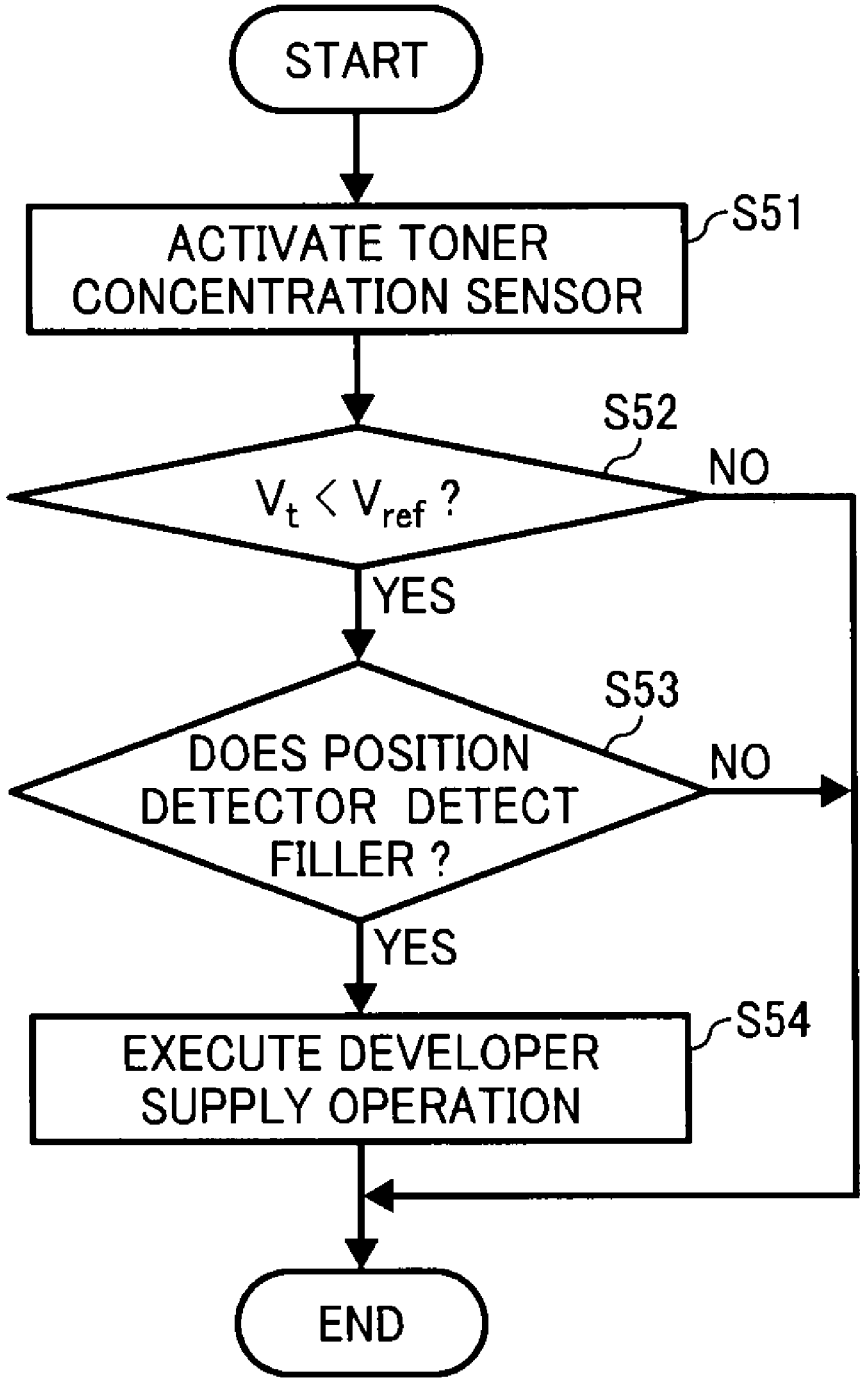
FIG. 23 illustrates a procedure to execute a developer supply mode using the disengagement detector shown in FIGS. 22A and 22B.

The procedure using the filler 182 and the position detector 195 is described below with reference FIGS. 22A, 22B, and 23.

When the developer supply mode is executed regarding the developing unit 4K for black, the controller 198 performs steps S51 and S52 that are similar to the steps S41 and S42 shown in FIG. 21, and thus descriptions thereof are omitted. After thus confirming that the developer is not present in the developing unit 4K, the controller 198 checks whether or not the position detector 195 detects the filler 182 at S53. When the position detector 195 detects the filler 182 (YES at S53), that is, the intermediate transfer belt 110 is disengaged from the photoreceptor 1K, the controller 198 executes the developer supply mode at S54.

By contrast, when the position detector 195 does not detect the filler 182 (NO at S53), the intermediate transfer belt 110 is in the partial disengagement mode and contacts the photoreceptor 1K, that is, the maintenance person has forgotten to rotate the lever 147 shown in FIG. 14. Therefore, the controller 198 causes the operating unit (operation display) 194 to display an error message, and terminates the procedure.

As described above, in the present embodiment, the developer supply mode is not executed while the intermediate transfer belt 110 engages the photoreceptors 1, preventing damage to the photoreceptors 1 and the intermediate transfer belt 110 caused by rubbing against each other.

Another illustrative embodiment in which the disengagement between the intermediate transfer belt 110 and the photoreceptor 1 is confirmed based on the rotational position of the second disengagement cam 144 is described below with reference to FIGS. 24A, 24B, and 25.

Figure 24A:
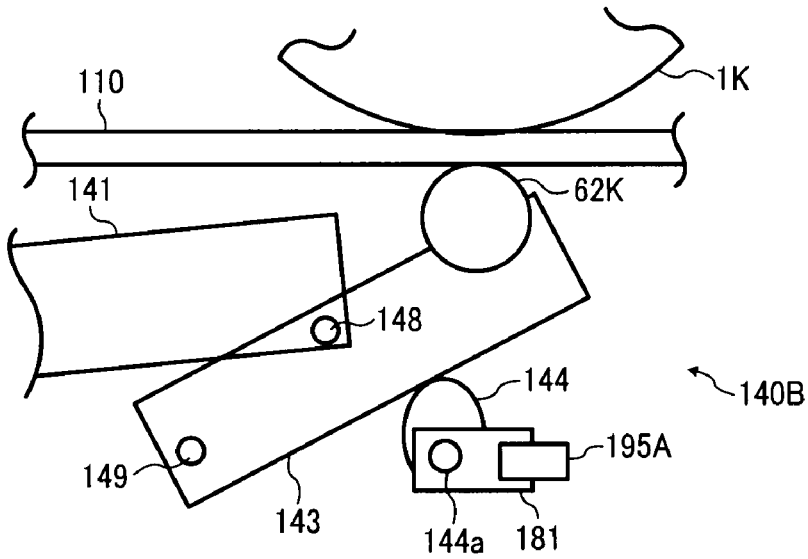
FIGS. 24A and 24B illustrate a disengagement detector according to another illustrative embodiment.
Figure 25:
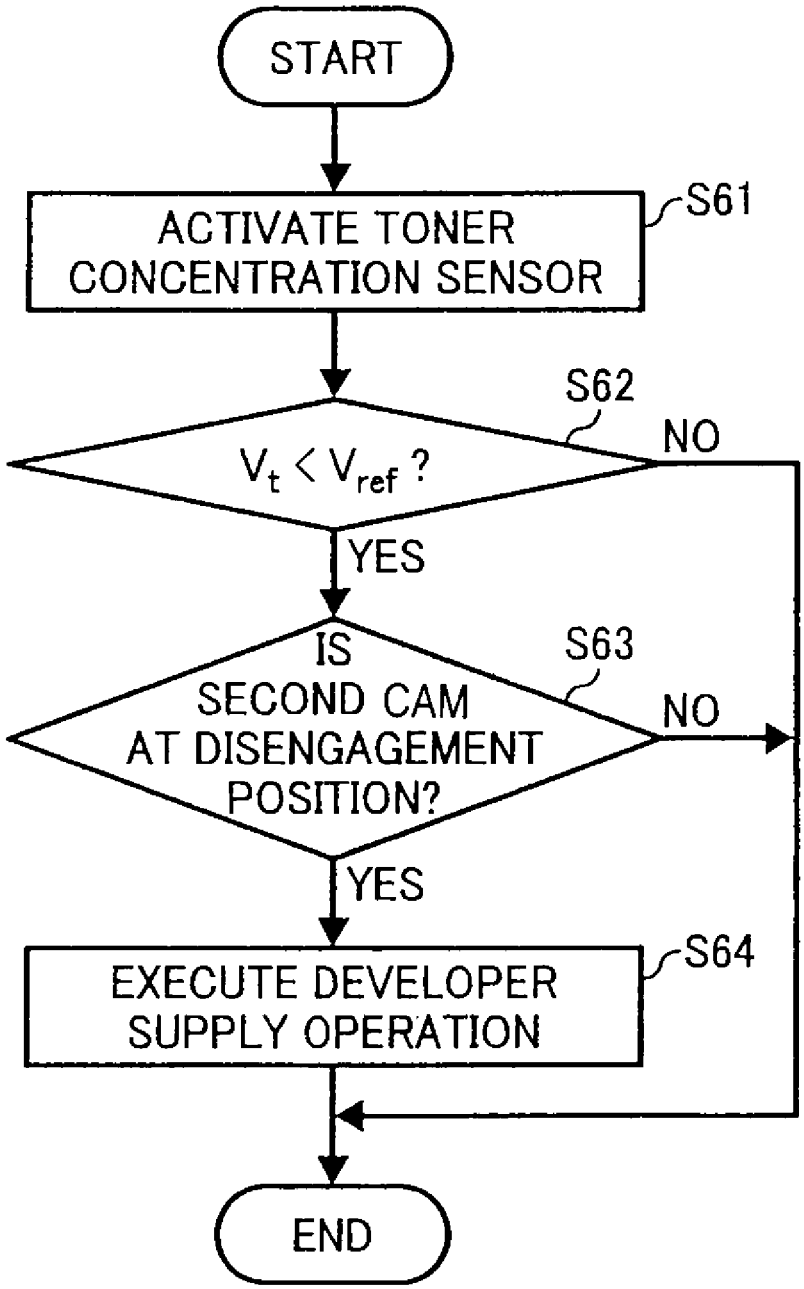
FIG. 25 illustrates a procedure to execute a developer supply mode using the disengagement detector shown in FIGS. 24A and 24B.

As shown in FIG. 24A, a disengagement unit 140B according to the present embodiment includes a filler 181 fixed to the shaft 144*a* and a position detector 195A. The position detector 195A has a configuration similar to that of the position detector 195 shown in FIGS. 22A and 22B. The filler 181 and the position detector 195A serve as a disengagement detector. Other than that, the disengagement unit 140B has a configuration similar to that of the disengagement unit 140 shown in FIG. 10, and thus a description thereof is omitted.

When the intermediate transfer belt 110 contacts the photoreceptor 1K, a part of the filler 181 is located between a light emitting element and a light receiving element of the position detector 195A, interrupting the light emitted from the light emitting element. Therefore, the position detector 195A does not output a predetermined or given output value.

Figure 24B:
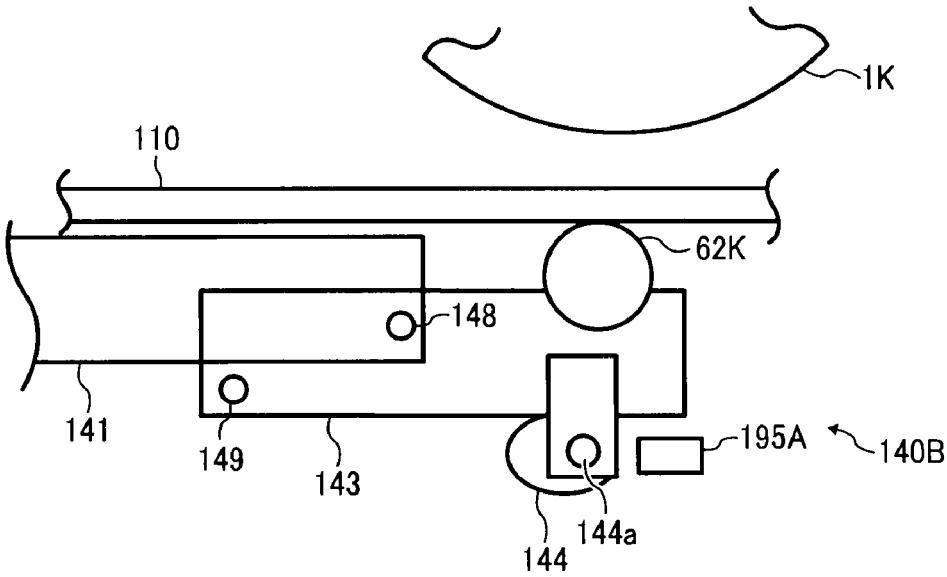

By contrast, when the second disengagement cam 144 is rotated by 90 degrees or about 90 degrees to the disengagement position shown in FIG. 24B, and accordingly the intermediate transfer belt 110 is disengaged from the photoreceptor 1K, the light receiving element of the position detector 195A receives the light emitted from the light emitting element. In this state, the position detector 195A outputs a predetermined or given output value. Thus, based on the output value of the position detector 195A, the rotational position of the second disengagement cam 144 can be detected, and accordingly disengagement between the intermediate transfer belt 110 and the photoreceptor 1K can be detected.

The procedure using the filler 181 and the position detector 195A is described below with reference FIGS. 24A, 24B, and 25.

When the developer supply mode is executed regarding the developing unit 4K for black, the controller 198 performs steps S61 and S62 that are similar to the steps S41 and S42 shown in FIG. 21, and thus descriptions thereof are omitted. After thus confirming that the developer is not present in the developing unit 4K (YES at S62), the controller 198 checks whether or not the second disengagement cam 144 is at the disengagement position shown in FIG. 24B at S63.

More specifically, when the position detector 195A outputs the predetermined output value, it is known that the second disengagement cam 144 is at the disengagement position as described above, and thus the controller 198 can confirm that the intermediate transfer belt 110 is disengaged from the photoreceptor 1K. When the second disengagement cam 144 is at the disengagement position (YES at S63), the controller 198 executes the developer supply mode at S64.

By contrast, when the second disengagement cam 144 is not at the disengagement position (NO at S63), that is, the intermediate transfer belt 110 is in the partial disengagement mode and contacts the photoreceptor 1K, the controller 198 causes the operating unit (operation display) 194 to display an error message, and terminates the procedure.

As described above, the developer supply mode is not executed while the intermediate transfer belt 110 engages the photoreceptors 1, preventing damage to the photoreceptors 1 and the intermediate transfer belt 110 caused by rubbing against each other as well in the present embodiment.

Another illustrative embodiment is described below with reference to FIG. 26.

Figure 26:
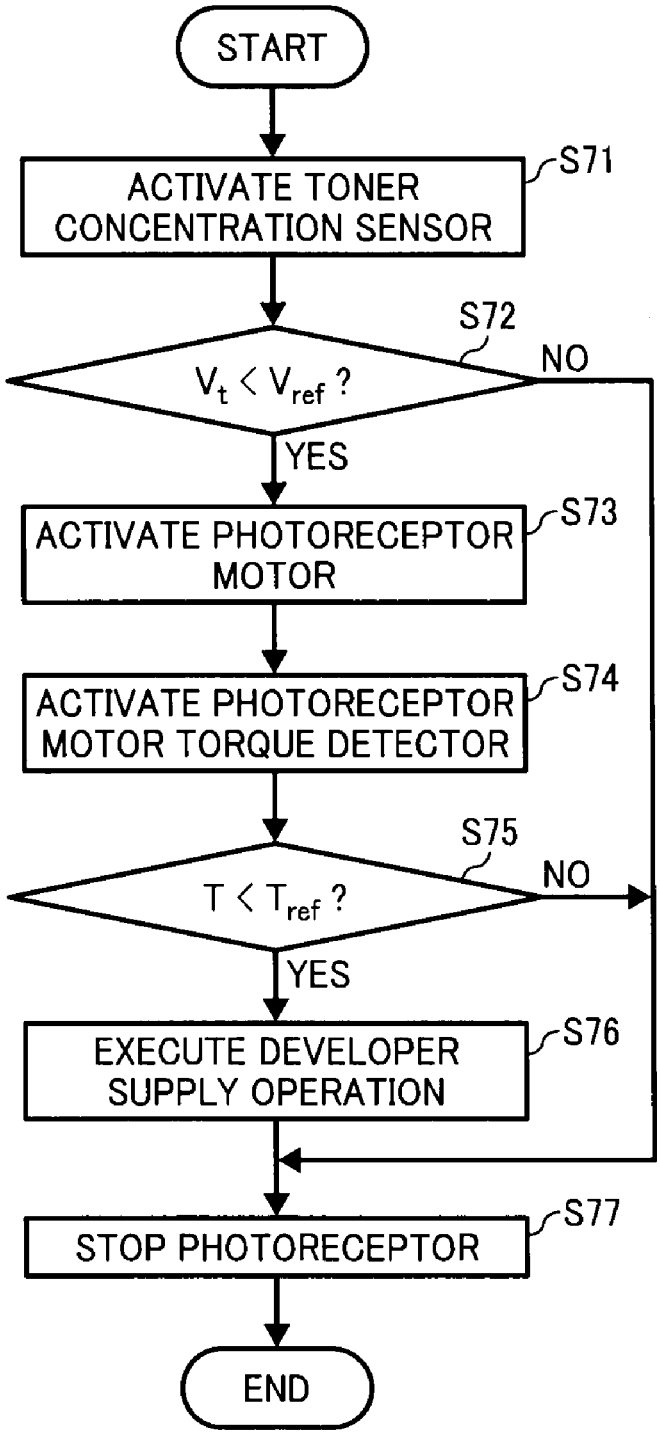
FIG. 26 illustrates a procedure to execute a developer supply mode according to another illustrative embodiment.

FIG. 26 is a flow chart illustrating a procedure in which disengagement of the intermediate transfer belt 110 from the photoreceptors 1 is detected based on an output value from the photoreceptor motor torque detector 196 that is used to detect an abnormal state of the image forming apparatus 100 shown in FIG. 1 by detecting that the load of the photoreceptor motor 192 is abnormally high.

That is, the photoreceptor motor torque detector 196 serves as a disengagement detector to detect disengagement of the intermediate transfer belt 110 from the photoreceptors 1. The photoreceptor motor torque detector 196 monitors and converts a driving current of the photoreceptor motor 192 into torque.

When the developer supply mode is executed for the developing unit 4K for black, the controller 198 performs steps S71 and S72 that are similar to the steps S41 and S42 shown in FIG. 21, and thus descriptions thereof are omitted. After confirming that the developer is not present in the developing unit 4K (YES at S72), the controller 198 activates the photoreceptor motor 192 at S73 and further activates the photoreceptor motor torque detector 196 at S74 so as to detect torque of the photoreceptor motor 192.

Then, at S75 the controller 198 checks whether or not a detected torque T of the development motor 193 is lower than a predetermined or given threshold $T_{ref}$. When the intermediate transfer belt 110 contacts the photoreceptor 1K, the torques of the photoreceptor 1K is higher, and accordingly the detected torque T is higher than the threshold $T_{ref}$. Because it is known that the detected torque T is higher than the threshold $T_{ref}$ (NO at S75) when the intermediate transfer belt 110 contacts the photoreceptor 1K, the controller 198 displays an error message on the operating unit 194, etc., and does not execute the developer supply mode.

By contrast, when the detected torque T is lower than the threshold $T_{ref}$ (YES at S75), that is, the intermediate transfer belt 110 is disengaged from the photoreceptor 1K, at S76 the controller 198 executes the developer supply mode and then stops the photoreceptor motor 192 at S77.

Alternatively, disengagement of the intermediate transfer belt 110 from the photoreceptor 1 can be determined based on driving torque of the intermediate transfer belt 110 using the belt driving motor torque detector 199 shown in FIG. 16. Alternatively, disengagement between the intermediate transfer belt 110 and the photoreceptor 1 may be detected based on driving torque of both the photoreceptor 1 and the intermediate transfer belt 110.

As described above, the developer supply mode is not executed while the intermediate transfer belt 110 engages the photoreceptors 1 as well in the procedure described above, preventing damage to the photoreceptors 1 and the intermediate transfer belt 110 caused by rubbing against each other. Further, because the photoreceptor motor torque detector 196 serves as the disengagement detector, a separate developer detector is not required, saving both the number of components used in the copier 100 as well as the cost.

A procedure to execute the toner supply mode according to another illustrative embodiment is described below with reference to FIGS. 27 and 28.

Figure 27:
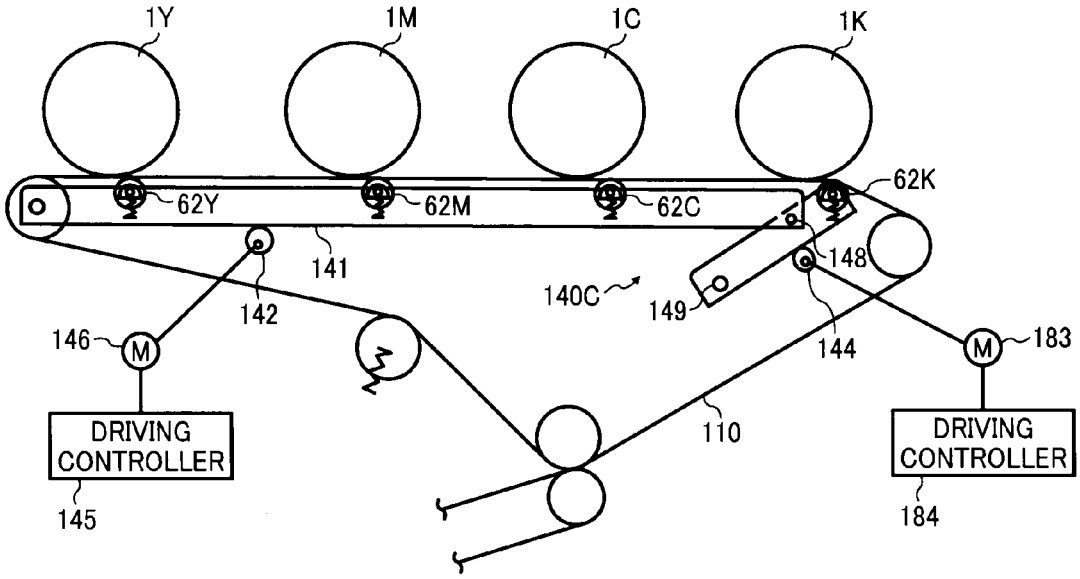
FIG. 27 illustrates a second disengagement motor configured to rotate the second disengagement cam.
Figure 28:
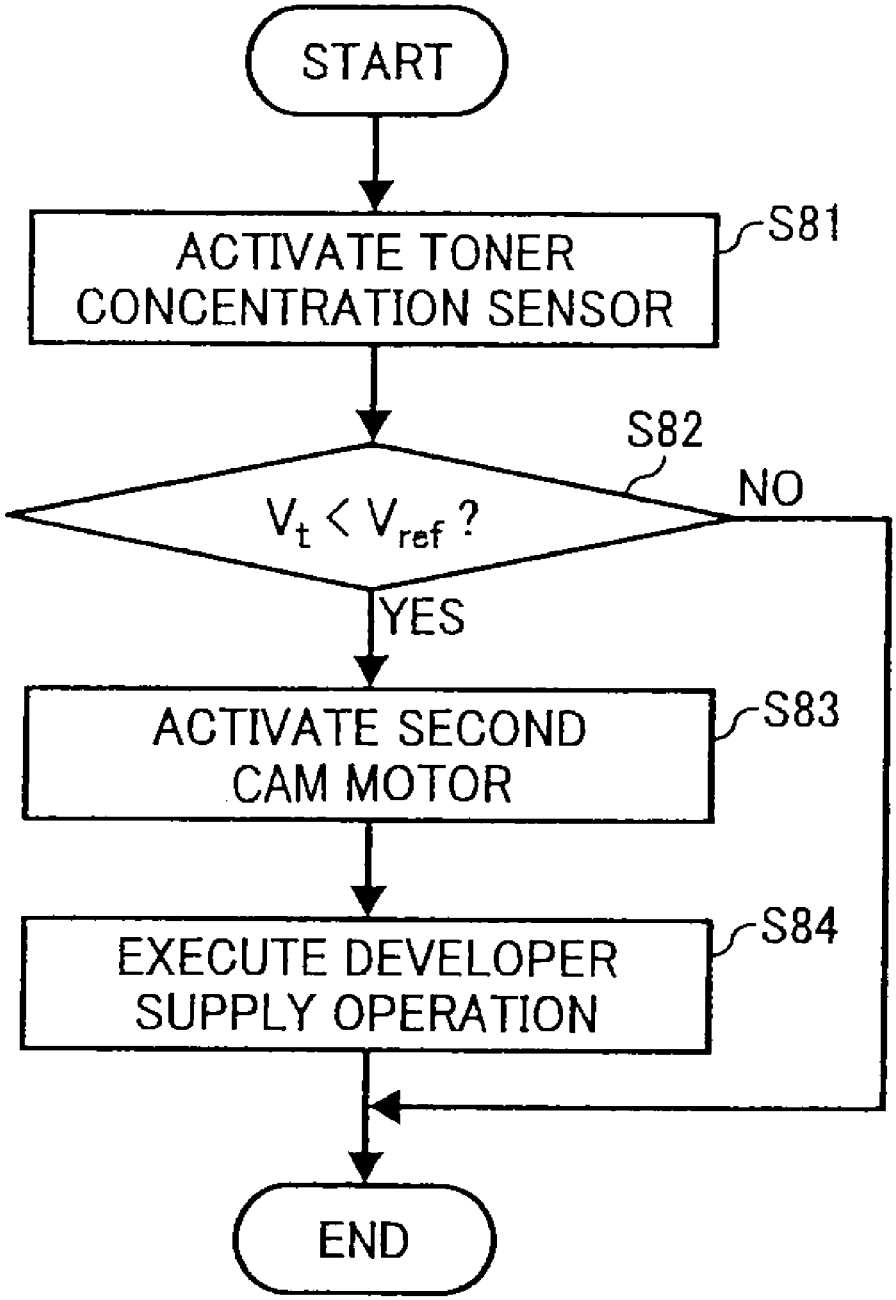
FIG. 28 illustrates a procedure to execute a developer supply mode using the second disengagement motor shown in FIG. 27.

As shown in FIG. 27, a disengagement unit 140C according to the present embodiment includes a second disengagement motor 183 to rotate the second disengagement cam 144 and a driving controller 184 to control the second disengagement motor 183, and the intermediate transfer belt 110 can be automatically disengaged from the photoreceptor 1K. Other than that, the disengagement unit 140A has a configuration similar to that of the disengagement unit 140 shown in FIG. 10, and thus a description thereof is omitted.

When the developer supply mode is executed regarding the developing unit 4K for black, the controller 198 performs steps S81 and S82 that are similar to the steps S41 and S42 shown in FIG. 21, and thus descriptions thereof are omitted. After confirming that the developer is not present in the developing unit 4K (YES at S82), the controller 198 activates the second disengagement motor 183 at S83 so as to disengage the intermediate transfer belt 110 from the photoreceptor 1K. Then, at S84 the controller 198 executes the developer supply mode.

Thus, the intermediate transfer belt 110 can be automatically disengaged from the photoreceptors 1 before executing the developer supply mode in the procedure described above, preventing damage to the photoreceptors 1 and the intermediate transfer belt 110 caused by rubbing against each other.

As described above, the image forming apparatus 100 according to the illustrative embodiments of the present invention includes the photoreceptors 1 serving as the latent image carriers, the developing units 4 to respectively develop the latent images formed on the photoreceptors 1 with the developer, the developer detector to detect whether or not the developer is present in the developer container part of the developing unit 4, and the controller 198 that supplies the developer to the developer container part from the toner bottle 120 set on the image forming apparatus 100 when the developer detector detects that the developer is not present therein.

In the configuration described above, because the developer is not supplied to the developer container part in which the developer is present, redundant replenishment of the developer due to human error can be prevented.

Further, the toner concentration sensor 191 shown in FIG. 2 can be used as the developer detector, and presence of the developer in the developer container part can be detected based on the output value thereof as shown in FIG. 18.

Alternatively, as shown in FIG. 19, the developer detector can be configured to detect presence of the developer in the developer container part based on the torque of the supply screw 8, agitation screw 11, and collection screw 6 serving as the developer transporters shown in FIG. 2.

Alternatively, a predetermined or given image can be formed on the photoreceptor 1 as the detection pattern. Presence of the developer can be detected by detecting the amount of the toner adhered to the image with the toner adhesion detector 190 shown in FIG. 2.

The image forming apparatus 100 further includes the disengagement unit 140 to engage/disengage the intermediate transfer belt 110 with/from the photoreceptors 1, the disengagement detector to detect whether or not the intermediate transfer belt 110 is disengaged therefrom. The controller 198 can be configured to supply the developer to the developer container part from the toner bottle 120 only when the developer detector detects that the developer is not present therein. With this configuration, the developer supply operation is not performed unless the intermediate transfer belt 110 is disengaged from the photoreceptors 1, preventing damage to the photoreceptors 1 and the intermediate transfer belt 110 caused by rubbing against each other.

The disengagement detector can be configured to detect disengagement between the intermediate transfer belt 110 and the photoreceptor 1 based on driving torque of one of the photoreceptor 1 and the intermediate transfer belt 110.

Alternatively, the disengagement detector can be configured to detect disengagement between the intermediate transfer belt 110 and the photoreceptor 1 based on a detection result generated by the position detector that detects position of the intermediate transfer belt 110.

Alternatively, position of the intermediate transfer belt 110 can be detected based on a rotational position of the disengagement cam.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus, comprising:

a latent image carrier configured to carry a latent image thereon;

a disengagement detector configured to detect whether or not an intermediate transfer member is disengaged from the latent image carrier;

a developing unit disposed facing the latent image carrier to develop the latent image with developer;

a developer container configured to contain the developer and to be attached to the image forming apparatus;

a developer detector configured to detect presence of the developer in the developing unit; and a developer supply controller configured to prohibit supply of the developer from the developer container to the developing unit when the developer detector detects that the developer is present in the developing unit, wherein the developer supply controller supplies the developer from the developer container to the developing unit when the disengagement detector detects that the intermediate transfer member is disengaged from the latent image carrier.

2. The image forming apparatus according to claim 1, wherein the developer detector is a toner concentration sensor located in the developing unit and detects the presence of the developer based on a result of toner concentration detection.

3. The image forming apparatus according to claim 1, wherein the developing unit further comprises a developer transporter that transports the developer inside the developing unit, and the developer detector detects presence of the developer in the developing unit based on torque of the developer transporter.

4. The image forming apparatus according to claim 1, wherein the developer detector is a toner adhesion detector disposed facing the latent image carrier to detect an amount of the toner adhered to the latent image carrier, a predetermined image is formed on the latent image carrier when supplying the developer to the developing unit from the developer container is instructed, the toner adhesion detector detects the amount of the toner adhered to the predetermined image, and the presence of the developer in the developing unit is detected based on a result of the toner adhesion detection.

5. The image forming apparatus according to claim 1, further comprising:

a transferor configured to transfer the image formed on the latent image carrier onto the intermediate transfer member; and a disengagement unit configured to engage the intermediate transfer member with the latent image carrier and disengage the intermediate transfer member therefrom.

6. The image forming apparatus according to claim 5, wherein the disengagement detector detects whether or not the intermediate transfer member is disengaged from the latent image carrier based on driving torque of at least one of the latent image carrier and the intermediate transfer member.

7. The image forming apparatus according to claim 5, wherein the disengagement detector is a position detector that detects a position of the intermediate transfer member, and the disengagement detector is configured to detect whether or not the intermediate transfer member is disengaged from the latent image carrier based on the position of the intermediate transfer member.

8. The image forming apparatus according to claim 7, wherein the disengagement unit includes a disengagement cam to disengage the intermediate transfer member from the latent image carrier, and the disengagement detector detects the position of the intermediate transfer member based on a rotational position of the disengagement cam.

9. A developer supply method used in an image forming apparatus including a latent image carrier on which a latent image is formed, a developing unit configured to develop the latent image, and a developer container to be set on the image forming apparatus, the developer supply method comprising:

detecting whether or not an intermediate transfer member is disengaged from the latent image carrier;

determining whether or not developer is present in the developing unit;

prohibiting supply of the developer to the developing unit from the developer container when the developer is determined to be present in the developing unit; and prohibiting supply of the developer to the developing unit from the developer container when the intermediate transfer member is not disengaged from the latent image carrier.

10. The developer supply method according to claim 9, further comprising detecting a toner concentration in the developing unit, wherein whether or not the developer is present in the developing unit is determined based on a result of the toner concentration detection.

11. The developer supply method according to claim 9, further comprising detecting a torque of a developer transporter that transports the developer in the developing unit, wherein whether or not the developer is present in the developing unit is determined based on the torque of the developer transporter.

12. The developer supply method according to claim 9, further comprising:

forming a predetermined image on the latent image carrier; and detecting an amount of the toner adhered to the predetermined image, wherein whether or not the developer is present in the developing unit is determined based on a result of the toner adhesion detection.

13. The developer supply method according to claim 9, further comprising:

disengaging the intermediate transfer member from the latent image carrier.

14. The developer supply method according to claim 13, wherein whether or not the intermediate transfer member is disengaged from the latent image carrier is determined based on driving torque of at least one of the latent image carrier and the intermediate transfer member.

15. The developer supply method according to claim 13, further comprising detecting a position of the intermediate transfer member, wherein whether or not the intermediate transfer member is disengaged from the latent image carrier is detected based on the position of the intermediate transfer member.

16. The developer supply method according to claim 15, wherein the intermediate transfer member is disengaged from the latent image carrier using a disengagement cam, and whether or not the intermediate transfer member is disengaged from the latent image carrier is detected based on a rotational position of the disengagement cam.

* * * * *